US011107409B2

(12) United States Patent
Yang et al.

(10) Patent No.: US 11,107,409 B2
(45) Date of Patent: Aug. 31, 2021

(54) DISPLAY DEVICE AND METHOD OF DRIVING THE SAME

(71) Applicant: SAMSUNG DISPLAY CO., LTD., Yongin-si (KR)

(72) Inventors: Jin-Wook Yang, Suwon-si (KR); Soon-Dong Kim, Osan-si (KR); Changnoh Yoon, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/795,798

(22) Filed: Feb. 20, 2020

(65) Prior Publication Data

US 2020/0365085 A1 Nov. 19, 2020

(30) Foreign Application Priority Data

May 14, 2019 (KR) ..... 10-2019-0056164

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2300/0452* (2013.01)

(58) Field of Classification Search
CPC ... G09G 2300/0426; G09G 2320/0242; G09G 3/3614; G09G 3/3648; G09G 2300/0452; G09G 2310/0297; G09G 2310/08; G09G 3/3233; G09G 3/3258; G09G 3/3266; G09G 3/3275
See application file for complete search history.

(56) References Cited

U.S. PATENT DOCUMENTS 8,681,081 B2 * 3/2014 Tsuda ..... G09G 3/3688 345/88
8,730,132 B2 * 5/2014 Choi ..... G09G 3/3291 345/76

(Continued)

FOREIGN PATENT DOCUMENTS

KR 10-0666646 1/2007
KR 10-2014-0093091 7/2014

(Continued)

*Primary Examiner* — Michael J Jansen, II
(74) *Attorney, Agent, or Firm* — F. Chau & Associates, LLC

(57) ABSTRACT

A display device includes a display unit including a first pixel, a second pixel disposed adjacent to the first pixel in a first direction, a third pixel disposed adjacent to the first pixel in a second direction crossing the first direction, and a fourth pixel disposed adjacent to the third pixel in the first direction. Each of the first to fourth pixels includes a first sub-pixel and a second sub-pixel. The display device further includes a data driver that outputs a plurality of data voltages, a selective output unit that outputs the data voltages to the first to fourth pixels in a different order for each of a plurality of frames, and a scan driver that outputs a first scan signal to the first and second pixels and outputs a second scan signal, which is delayed from the first scan signal, to the third and fourth pixels.

20 Claims, 15 Drawing Sheets

(56) References Cited

U.S. PATENT DOCUMENTS 8,816,998 B2 * 8/2014 Pyon ..... G09G 3/3275 345/204
9,183,774 B2 * 11/2015 Park ..... G09G 3/2096
9,262,956 B2 * 2/2016 Jeong ..... G09G 3/2003
9,530,348 B2 * 12/2016 Lee ..... G09G 3/3233
9,530,374 B2 * 12/2016 Jeong ..... G09G 3/3688
9,672,767 B2 * 6/2017 Kim ..... G09G 3/2074
9,741,280 B2 * 8/2017 Kong ..... G09G 3/2003
9,941,340 B2 * 4/2018 Lee ..... H01L 27/3276
10,354,582 B2 * 7/2019 Kim ..... G09G 3/3275
10,373,566 B2 * 8/2019 Lee ..... G09G 3/3258
10,403,704 B2 * 9/2019 Chae ..... H01L 27/3262
10,482,804 B2 * 11/2019 Kong ..... G09G 3/2003
10,593,278 B2 * 3/2020 Lee ..... G09G 3/3677
10,650,748 B2 * 5/2020 Kim ..... G09G 3/3266
10,679,551 B2 * 6/2020 Yang ..... G09G 3/3225
10,748,983 B2 * 8/2020 Li ..... G09G 3/3266
10,783,848 B2 * 9/2020 Lee ..... G09G 3/3685
10,789,899 B2 * 9/2020 Ikeda ..... G09G 3/007
2007/0057877 A1 * 3/2007 Choi ..... G09G 3/3291 345/76
2008/0309599 A1 * 12/2008 Tsuda ..... G09G 3/3688 345/88
2009/0189881 A1 * 7/2009 Ooishi ..... G09G 3/3688 345/211
2012/0313903 A1 * 12/2012 Pyon ..... G09G 3/32 345/204
2013/0208016 A1 * 8/2013 Park ..... G09G 3/2096 345/690
2014/0198135 A1 * 7/2014 Eom ..... G09G 3/3275 345/690
2015/0015464 A1 * 1/2015 Lee ..... G09G 3/3233 345/76
2015/0015590 A1 * 1/2015 Jeong ..... G09G 3/2003 345/502
2015/0248855 A1 * 9/2015 Kim ..... G09G 3/3291 345/590
2015/0287378 A1 * 10/2015 Jeong ..... G09G 3/3685 345/694
2016/0240146 A1 * 8/2016 Lee ..... G09G 3/2003
2016/0247452 A1 * 8/2016 Lee ..... H01L 27/3272
2016/0321977 A1 * 11/2016 Kong ..... G09G 3/2003
2017/0039923 A1 * 2/2017 Feng ..... G09G 3/3225
2017/0076665 A1 * 3/2017 Kim ..... G09G 3/3275
2017/0221979 A1 * 8/2017 Chae ..... H01L 27/3262
2017/0345357 A1 * 11/2017 Kong ..... G09G 3/2003
2018/0151137 A1 * 5/2018 Lee ..... G09G 3/3607
2018/0151145 A1 * 5/2018 Lee ..... G09G 3/3688
2018/0315384 A1 * 11/2018 Ikeda ..... G09G 3/3614
2019/0043421 A1 * 2/2019 Yang ..... G09G 3/3225
2019/0080651 A1 * 3/2019 Kim ..... G09G 3/3233
2019/0164502 A1 5/2019 Yoon et al.
2020/0203460 A1 * 6/2020 Li ..... G09G 3/006

FOREIGN PATENT DOCUMENTS

KR 10-2017-0031323 3/2017
KR 10-2018-0000037 1/2018
KR 10-1875127 6/2018
KR 10-2019-0015664 2/2019
KR 10-2019-0030266 3/2019
KR 10-2019-0062679 6/2019

* cited by examiner

DISPLAY DEVICE AND METHOD OF DRIVING THE SAME

CROSS-REFERENCE TO RELATED APPLICATIONS

This application claims priority under 35 USC § 119 to Korean Patent Application No. 10-2019-0056164 filed on May 14, 2019 in the Korean Intellectual Property Office (KIPO), the entire disclosure of which is incorporated by reference herein in its entirety.

TECHNICAL FIELD

Exemplary embodiments relate to a display device having improved display quality, and a method of driving the same.

DISCUSSION OF THE RELATED ART

Flat panel display devices are becoming more widely used as display devices. In particular, organic light emitting display devices are becoming more widely used because they are relatively thin and light, consume relatively low power, and have relatively high response speed compared to other types of flat panel display devices.

An organic light emitting display device may include a plurality of thin film transistors and organic light emitting elements connected to the thin film transistors. Each organic light emitting element may emit light having a luminance corresponding to a voltage supplied to the organic light emitting element through the corresponding thin film transistor.

A pixel of the display device may include red, green, and blue sub-pixels. In general, the pixel has a stripe structure in which red, green, and blue sub-pixels are arranged in a vertical direction. However, unlike the stripe structure, the pixel may instead have a pentile structure in which the pixel includes red and green sub-pixels or blue and green sub-pixels.

SUMMARY

Exemplary embodiments provide a display device having an improved display quality, and a method of driving the same.

According to exemplary embodiments, a display device includes a display unit including a first pixel, a second pixel disposed adjacent to the first pixel in a first direction, a third pixel disposed adjacent to the first pixel in a second direction crossing the first direction, and a fourth pixel disposed adjacent to the third pixel in the first direction. Each of the first to fourth pixels includes a first sub-pixel and a second sub-pixel. The display device further includes a data driver configured to output a plurality of data voltages, a selective output unit configured to output the data voltages to the first to fourth pixels in a different order for each of a plurality of frames, and a scan driver configured to output a first scan signal to the first pixel and the second pixel and to output a second scan signal, which is delayed from the first scan signal, to the third pixel and the fourth pixel.

In exemplary embodiments, the display unit further includes a first data line, a second data line, a third data line, a fourth data line, a fifth data line, a sixth data line, a seventh data line, and an eighth data line arranged in the first direction and extending in the second direction. The first sub-pixel and the second sub-pixel of the first pixel are connected to the second data line and the third data line, respectively. The first sub-pixel and the second sub-pixel of the second pixel are connected to the sixth data line and the seventh data line, respectively. The first sub-pixel and the second sub-pixel of the third pixel are connected to the fifth data line and the fourth data line, respectively. The first sub-pixel and the second sub-pixel of the fourth pixel are connected to the first data line and the eighth data line, respectively.

In exemplary embodiments, the selective output unit includes a first switch group configured to connect a first output terminal and a second output terminal of the data driver to the second data line and the third data line, respectively, in response to a first switch control signal. The selective output unit further includes a second switch group configured to connect the first output terminal and the second output terminal to the sixth data line and the seventh data line, respectively, in response to a second switch control signal. The selective output unit further includes a third switch group configured to connect the first output terminal and the second output terminal to the fifth data line and the fourth data line, respectively, in response to a third switch control signal. The selective output unit further includes a fourth switch group configured to connect the first output terminal and the second output terminal to the first data line and the eighth data line, respectively, in response to a fourth switch control signal.

In exemplary embodiments, the first sub-pixel of each of the first pixel and the third pixel is a red sub-pixel, the first sub-pixel of each of the second pixel and the fourth pixel is a blue sub-pixel, and the second sub-pixel of each of the first pixel, the second pixel, the third pixel, and the fourth pixel is a green sub-pixel.

In exemplary embodiments, the first scan signal is activated for one horizontal period beginning from a latter section of a first horizontal period, and the second scan signal is activated for one horizontal period beginning from a latter section of a second horizontal period that is consecutive to the first horizontal period.

In exemplary embodiments, in an Nth frame, the selective output unit outputs the data voltage of the first pixel in an initial section of the first horizontal period, outputs the data voltage of the second pixel in the latter section of the first horizontal period, outputs the data voltage of the fourth pixel in an initial section of the second horizontal period that is consecutive to the first horizontal period, and outputs the data voltage of the third pixel in the latter section of the second horizontal period.

In exemplary embodiments, the red sub-pixel of the first pixel stores the data voltage in a floating state with the data driver, and the red sub-pixel of the third pixel stores the data voltage in a connection state with the data driver.

In exemplary embodiments, the green sub-pixel of each of the second pixel and the third pixel stores the data voltage in a connection state with the data driver, and the green sub-pixel of each of the first pixel and the fourth pixel stores the data voltage in a floating state with the data driver.

In exemplary embodiments, the blue sub-pixel of the second pixel stores the data voltage in a connection state with the data driver, and the blue sub-pixel of the fourth pixel stores the data voltage in a floating state with the data driver.

In exemplary embodiments, in an (N+1)th frame, the selective output unit outputs the data voltage of the second pixel in an initial section of the first horizontal period, outputs the data voltage of the first pixel in the latter section of the first horizontal period, outputs the data voltage of the third pixel in an initial section of the second horizontal period that is consecutive to the first horizontal period, and outputs the data voltage of the fourth pixel in the latter section of the second horizontal period.

In exemplary embodiments, the red sub-pixel of the first pixel stores the data voltage in a connection state with the data driver, and the red sub-pixel of the third pixel stores the data voltage in a floating state with the data driver.

In exemplary embodiments, the green sub-pixel of each of the first pixel and the fourth pixel stores the data voltage in a connection state with the data driver, and the green sub-pixel of each of the second pixel and the third pixel stores the data voltage in a floating state with the data driver.

In exemplary embodiments, the blue sub-pixel of the second pixel stores the data voltage in a floating state with the data driver, and the blue sub-pixel of the fourth pixel stores the data voltage in a connection state with the data driver.

According to exemplary embodiments, a method of driving a display device includes outputting a plurality of data voltages by a data driver to a first pixel of a display unit, a second pixel of the display unit, a third pixel of the display unit, and a fourth pixel of the display unit in a different order for each of a plurality of frames. The second pixel is disposed adjacent to the first pixel in a first direction, the third pixel is disposed adjacent to the first pixel in a second direction crossing the first direction, and the fourth pixel is disposed adjacent to the third pixel in the first direction. Each of the first to fourth pixels comprises a first sub-pixel and a second sub-pixel. The method further includes outputting a first scan signal to the first pixel and the second pixel, and outputting a second scan signal which is delayed from the first scan signal to the third pixel and the fourth pixel.

In exemplary embodiments, in an Nth frame, the first pixel stores a first data voltage in a floating state with the data driver in an initial section of a first horizontal period, the second pixel stores a second data voltage in a connection state with the data driver in a latter section of the first horizontal period, the fourth pixel stores the first data voltage in a floating state with the data driver in an initial section of a second horizontal period that is consecutive to the first horizontal period, and the third pixel stores the second data voltage in a connection state with the data driver in a latter section of the second horizontal period.

In exemplary embodiments, the first data voltage stored in a red sub-pixel of the first pixel and the second data voltage stored in a red sub-pixel of the third pixel are alternately arranged in a zigzag manner in the second direction, and the second data voltage stored in a blue sub-pixel of the second pixel and the first data voltage stored in a blue sub-pixel of the fourth pixel are alternately arranged in a zigzag manner in the second direction.

In exemplary embodiments, the first data voltage stored in a green sub-pixel of the first pixel and the second data voltage stored in a green sub-pixel of the third pixel are alternately arranged in the second direction, and the second data voltage stored in a green sub-pixel of the second pixel and the first data voltage stored in a green sub-pixel of the fourth pixel are alternately arranged in the second direction.

In exemplary embodiments, in an (N+1)th frame, the second pixel stores a first data voltage in a floating state with the data driver in an initial section of a first horizontal period, the first pixel stores a second data voltage in a connection state with the data driver in a latter section of the first horizontal period, the third pixel stores the first data voltage in a floating state with the data driver in an initial section of a second horizontal period that is consecutive to the first horizontal period, and the fourth pixel stores the second data voltage in a connection state with the data driver in a latter section of the second horizontal period.

In exemplary embodiments, the second data voltage stored in a red sub-pixel of the first pixel and the first data voltage stored in a red sub-pixel of the third pixel are alternately arranged in a zigzag manner in the second direction, and the first data voltage stored in a blue sub-pixel of the second pixel and the second data voltage stored in a blue sub-pixel of the fourth pixel are alternately arranged in a zigzag manner in the second direction.

In exemplary embodiments, the second data voltage stored in a green sub-pixel of the first pixel and the first data voltage stored in a green sub-pixel of the third pixel are alternately arranged in the second direction, and the first data voltage stored in a green sub-pixel of the second pixel and the second data voltage stored in a green sub-pixel of the fourth pixel are alternately arranged in the second direction.

Therefore, according to exemplary embodiments an improved display device having a pentile sub-pixel structure, a demultiplexer structure for reducing the number of output terminals of a data driver, and a two data line structure in which sub-pixels included in one pixel column are driven by using two data lines to extend a data writing time and a compensation time of the pixel, is provided. A method of driving the display device according to exemplary embodiments may improve a display failure/display defect caused due to a time difference of data voltages stored in the pixel by controlling a switching order of the demultiplexer and an output of the data voltage corresponding to the switching order.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EXEMPLARY EMBODIMENTS

Figure 1:
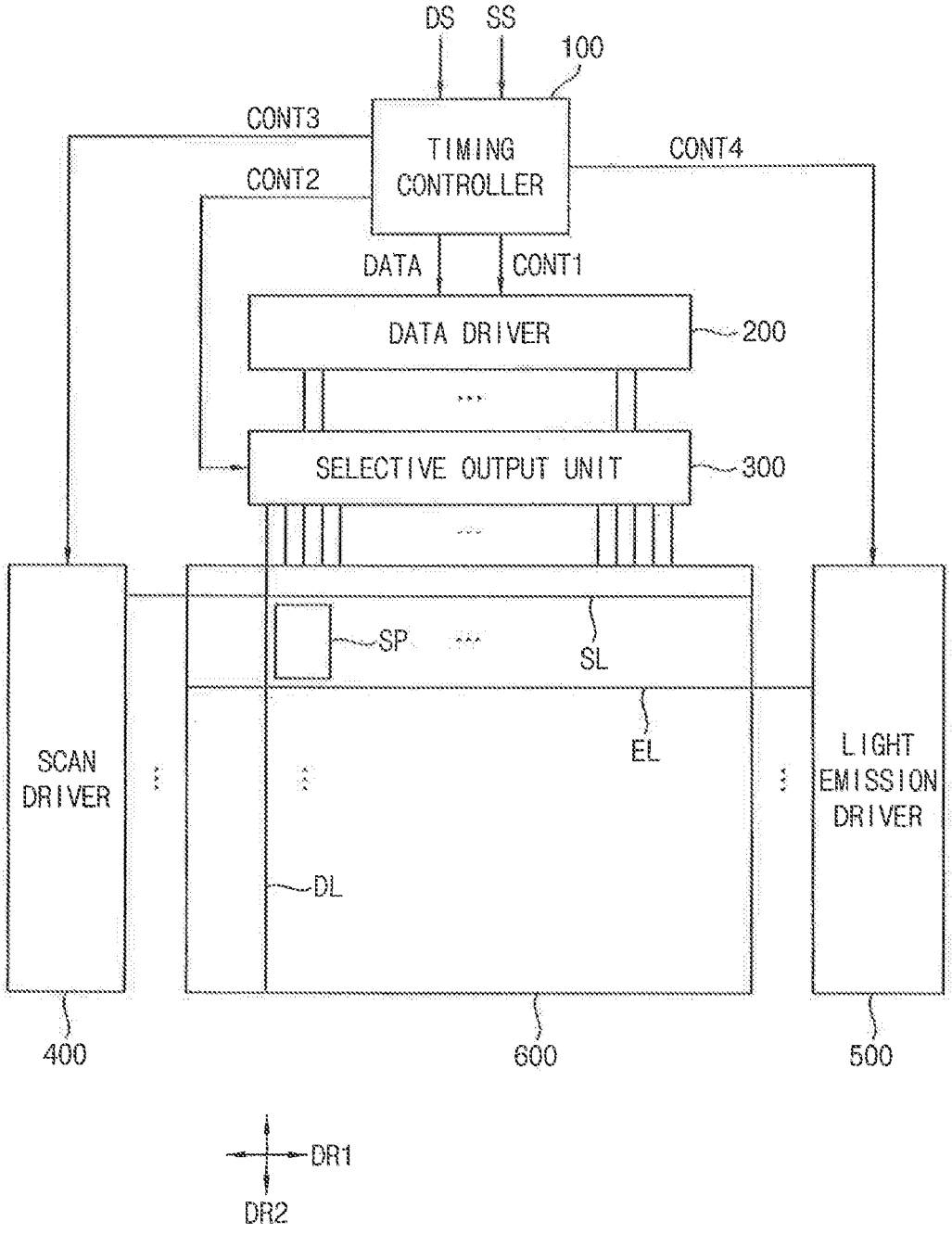
FIG. 1 is a block diagram illustrating a display device according to exemplary embodiments.

Exemplary embodiments of the present invention will be described more fully hereinafter with reference to the accompanying drawings. Like reference numerals may refer to like elements throughout the accompanying drawings.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

Figure 2:
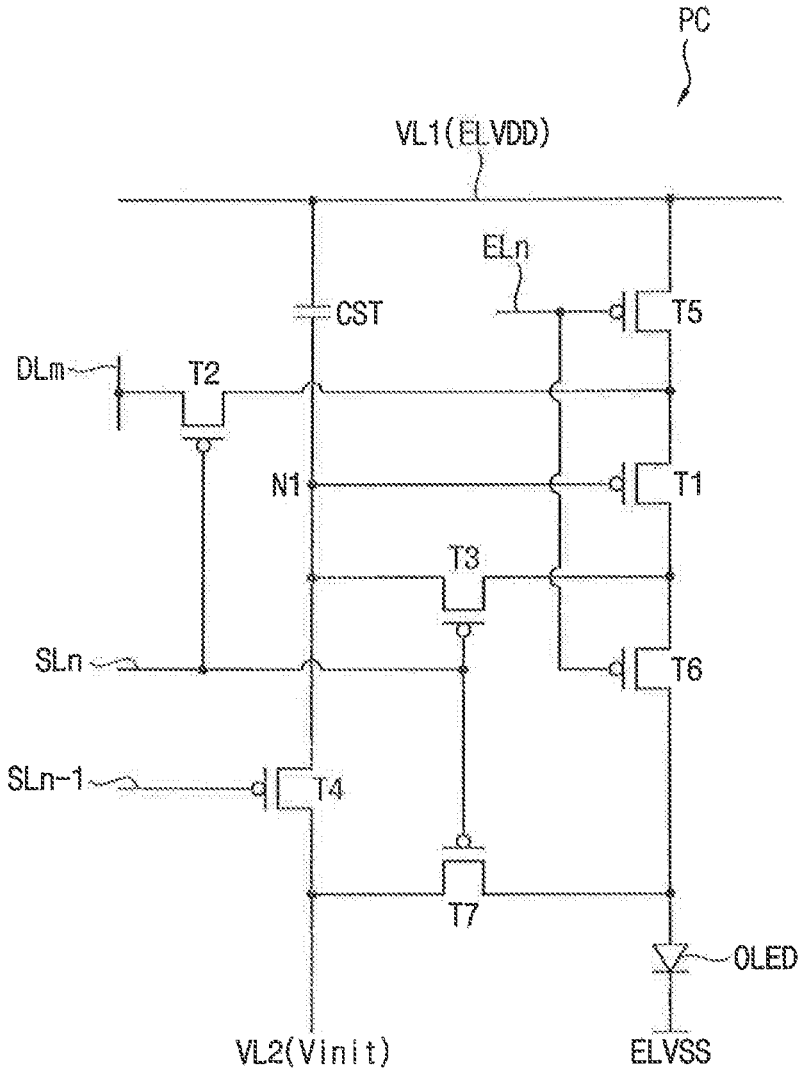
FIG. 2 is a circuit diagram illustrating a sub-pixel according to exemplary embodiments.

FIG. 1 is a block diagram illustrating a display device according to exemplary embodiments. FIG. 2 is a circuit diagram illustrating a sub-pixel according to exemplary embodiments.

Referring to FIG. 1, the display device may include a timing controller 100, a data driver 200, a selective output unit 300, a scan driver 400, a light emission driver 500, and a display unit 600.

Herein, the term "display unit" may be used to refer to a plurality of pixels that display an image, and/or a plurality of data lines connected to the plurality of pixels. Each of the timing controller 100, the data driver 200, the selective output unit 300, the scan driver 400, and the light emission driver 500 may be implemented as an electronic circuit. Thus, the timing controller 100 may also be referred to as a timing controller circuit, the data driver 200 may also be referred to as a data driver circuit, the selective output unit 300 may also be referred to as a selective output circuit, the scan driver 400 may also be referred to as a scan driver circuit, and the light emission driver 500 may also be referred to as a light emission driver circuit.

The timing controller 100 may receive an image signal DS and a control signal CS from an external device. The image signal DS may include, for example, red, green, and blue grayscale data. The control signal CS may include, for example, a horizontal synchronization signal, a vertical synchronization signal, a main clock signal, etc.

The timing controller 100 may convert the red, green, and blue grayscale data DS into red and green grayscale data or blue and green grayscale data DATA, which corresponds to a pentile sub-pixel structure of the display unit 600, and may provide the red and green grayscale data or blue and green grayscale data DATA to the data driver 200.

The timing controller 100 may generate a first control signal CONT1 for controlling the driving of the data driver 200, and may provide the first control signal CONT1 to the data driver 200. The timing controller 100 may also generate a second control signal CONT2 for controlling the driving of the selective output unit 300, and may provide the second control signal CONT2 to the selective output unit 300. The timing controller 100 may also generate a third control signal CONT3 for controlling the driving of the scan driver 400, and may provide the third control signal CONT3 to the scan driver 400. The timing controller 100 may also generate a fourth control signal CONT4 for controlling the driving of the light emission driver 500, and may provide the fourth control signal CONT4 to the light emission driver 500.

The data driver 200 may convert the red and green grayscale data or blue and green grayscale data DATA into a data voltage by using a gamma voltage, and may output the data voltage based on the first control signal CONT1.

The selective output unit 300 may be, for example, a demultiplexer (also referred to as a demux). The selective output unit 300 may include a plurality of input terminals connected to a plurality of output terminals of the data driver 200, and a plurality of output terminals connected to a plurality of data lines DL arranged on the display unit 600. The number of the input terminals of the selective output unit 300 may be smaller than the number of the output terminals of the selective output unit 300.

The selective output unit 300 may output a plurality of data voltages input from the output terminals of the data driver 200 to the data lines, where the number of the data lines is greater than the number of the output terminals of the data driver 200, through a time division scheme according to a control of the second control signal CONT2. The selective output unit 300 may be used to reduce the number of the output terminals of the data driver 200 as compared with the number of the data lines.

For example, the selective output unit 300 may output two data voltages provided from the data driver 200 to eight data lines through the time division scheme.

The selective output unit 300 may output the data voltages to a plurality of pixels included in the display unit 600 (e.g., first to fourth pixels P1 to P4 described below) in a different order for each of a plurality of frames, as described in more detail below with reference to FIGS. 6, 7A-7C, 8 and 9A-9C.

The scan driver 400 may generate a scan signal based on the third control signal CONT3, and may output the scan signal to a plurality of scan lines SL of the display unit 600.

The light emission driver 500 may generate a light emission control signal based on the fourth control signal CONT4, and may output the light emission control signal to a plurality of light emission control lines EL of the display unit 600.

The display unit 600 may include a plurality of scan lines SL, a plurality of data lines DL, a plurality of light emission control lines EL, and a plurality of sub-pixels SP.

The scan lines SL may extend in a first direction DR1 and may be arranged in a second direction DR2 crossing the first direction DR1.

The data lines DL may extend in the second direction DR2 and may be arranged in the first direction DR1.

The light emission control lines EL may extend in the first direction DR1 and may be arranged in the second direction DR2.

The display unit 600 may further include a first voltage line VL1 that transmits a first power supply voltage ELVDD, and a second voltage line VL2 that transmits an initialization voltage Vint (see FIG. 2).

The sub-pixels SP may be arranged in various forms (e.g., a matrix form) including a plurality of pixel rows and a plurality of pixel columns. A pixel row may include a plurality of sub-pixels arranged in the first direction DR1, and a pixel column may include a plurality of sub-pixels arranged in the second direction DR2.

In an exemplary embodiment, the display unit 600 may have a pentile sub-pixel structure.

In an exemplary embodiment, in the demux structure for reducing the output terminal of the data driver 200, a two data line structure in which the sub-pixels SP of the pixel column are driven by using two data lines to extend a data writing time and a compensation time of the sub-pixel may be provided, as described in further detail below.

Referring to FIG. 2, the sub-pixel SP may include a pixel circuit PC.

The pixel circuit PC may include an organic light emitting diode OLED, first, second, third, fourth, fifth, sixth, and seventh transistors T1, T2, T3, T4, T5, T6, and T7, and a storage capacitor CST.

An anode of the organic light emitting diode OLED may be connected to the first transistor T1 via the sixth transistor T6, and a cathode of the organic light emitting diode OLED may receive a second power supply voltage ELVSS. The organic light emitting diode OLED may generate light having a predetermined luminance corresponding to an amount of a current supplied from the first transistor T1.

The first power supply voltage ELVDD may be set to be a voltage higher than the second power supply voltage ELVSS so that the current may flow to the organic light emitting diode OLED.

The seventh transistor T7 may be connected between the second voltage line VL2 that receives the initialization voltage Vint and the anode of the organic light emitting diode OLED. A gate electrode of the seventh transistor T7 may be connected to an $n^{th}$ scan line SLn or an $(n-1)^{th}$ scan line SLn−1. For example, when the gate electrode of the seventh transistor T7 is connected to the $n^{th}$ scan line SLn, the seventh transistor T7 may be turned on in response to the scan signal applied to the $n^{th}$ scan line SLn to apply the initialization voltage Vint to the anode of the organic light emitting diode OLED. The initialization voltage Vint may be set to be a voltage lower than a voltage of a data signal.

The sixth transistor T6 may be connected between the first transistor T1 and the organic light emitting diode OLED. In addition, a gate electrode of the sixth transistor T6 may be connected to an $n^{th}$ light emission control line ELn. The sixth transistor T6 may be turned on in response to the light emission control signal applied to the $n^{th}$ light emission control line ELn.

The fifth transistor T5 may be connected between the first voltage line VL1 that receives the first power supply voltage ELVDD and the first transistor T1. In addition, a gate electrode of the fifth transistor T5 may be connected to the $n^{th}$ light emission control line ELn. The fifth transistor T5 may be turned on in response to the light emission control signal applied to the $n^{th}$ light emission control line ELn.

A first electrode of the first transistor T1 may be connected to the first voltage line VL1 that receives the first power supply voltage ELVDD via the fifth transistor T5, and a second electrode of the first transistor T1 may be connected to the anode of the organic light emitting diode OLED via the sixth transistor T6. A gate electrode of the first transistor T1 may be connected to a first node N1. The first transistor T1 may control the amount of the current flowing from the first power supply voltage ELVDD to the second power supply voltage ELVSS via the organic light emitting diode OLED correspondingly to a voltage of the first node N1.

The third transistor T3 may be connected between the second electrode of the first transistor T1 and the first node N1. A gate electrode of the third transistor T3 may be connected to the $n^{th}$ scan line SLn. The third transistor T3 may be turned on in response to the scan signal applied to the $n^{th}$ scan line SLn to electrically connect the second electrode of the first transistor T1 to the first node N1. Therefore, when the third transistor T3 is turned on, the first transistor T1 may be connected in the form of a diode so that a threshold voltage may be compensated.

The fourth transistor T4 may be connected between the first node N1 and the second voltage line VL2 that receives the initialization voltage Vint. A gate electrode of the fourth transistor T4 may be connected to the $(n-1)^{th}$ scan line SLn−1. The fourth transistor T4 may be turned on in response to the scan signal applied to the $(n-1)^{th}$ scan line SLn−1, and the initialization voltage Vint may be applied to the first node N1.

The second transistor T2 may be connected to an $m^{th}$ data line DLm and the first electrode of the first transistor T1, in which m is a positive integer. A gate electrode of the second transistor T2 may be connected to the $n^{th}$ scan line SLn. The second transistor T2 is turned on in response to the scan signal applied to the $n^{th}$ scan line SLn to electrically connect the $m^{th}$ data line DLm to the first electrode of the first transistor T1.

The storage capacitor CST may be connected between the first voltage line VL1 that receives the first power supply voltage ELVDD and the first node N1. The storage capacitor CST may store the data signal and a voltage corresponding to the threshold voltage of the first transistor T1.

In an exemplary embodiment, the first to seventh transistors T1 to T7 included in the pixel circuit PC may be P-type transistors. Alternatively, the first to seventh transistors T1 to T7 may be N-type transistors.

Figure 3:
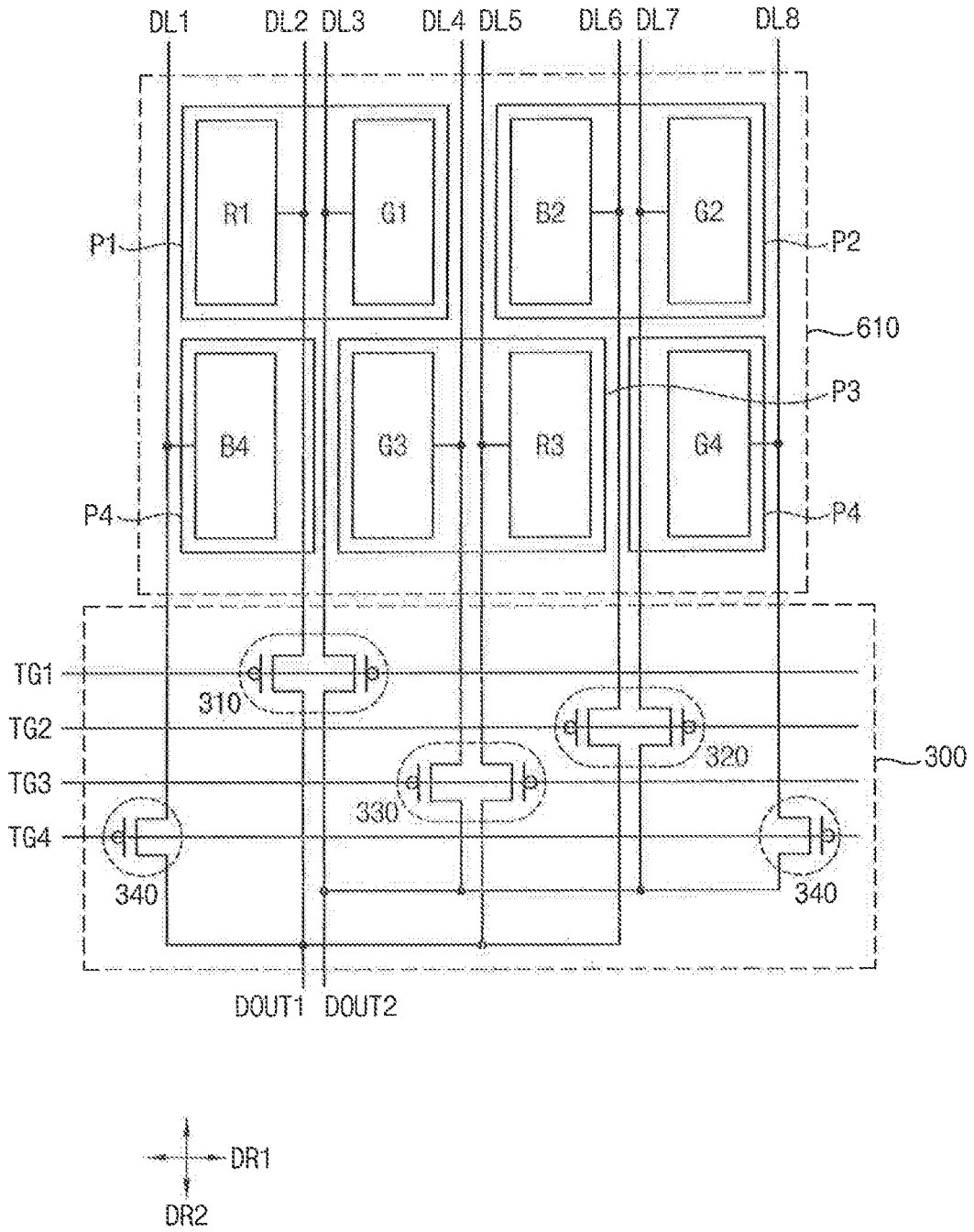
FIG. 3 is a conceptual diagram for describing a display unit and a selective output unit according to exemplary embodiments.

FIG. 3 is a conceptual diagram for describing a display unit and a selective output unit according to exemplary embodiments.

Referring to FIG. 3, the display unit may include a unit pixel 610.

The unit pixel 610 may include first, second, third, and fourth pixels P1, P2, P3, and P4. The first pixel P1 may be an odd-numbered pixel in a first pixel row, the second pixel P2 may be an even-numbered pixel in the first pixel row, the third pixel P3 may be an odd-numbered pixel in a second pixel row, and the fourth pixel P4 may be an even-numbered pixel in the second pixel row.

The first pixel P1 may include a first red sub-pixel R1 and a first green sub-pixel G1. The first red sub-pixel R1 may be connected to a second data line DL2, and the first green sub-pixel G1 may be connected to a third data line DL3.

The second pixel P2 may include a second blue sub-pixel B2 and a second green sub-pixel G2. The second blue sub-pixel B2 may be connected to a sixth data line DL6, and the second green sub-pixel G2 may be connected to a seventh data line DL7.

The third pixel P3 may include a third green sub-pixel G3 and a third red sub-pixel R3. The third green sub-pixel G3 may be connected to a fourth data line DL4, and the third red sub-pixel R3 may be connected to a fifth data line DL5.

The fourth pixel P4 may include a fourth blue sub-pixel B4 and a fourth green sub-pixel G4. The fourth blue sub-pixel B4 may be connected to a first data line DL1, and the fourth green sub-pixel G4 may be connected to an eighth data line DL8.

The first red sub-pixel R1 and the fourth blue sub-pixel B4 included in a first pixel column of the unit pixel 610 may be alternately connected to the first and second data lines DL1 and DL2.

The first green sub-pixel G1 and the third green sub-pixel G3 included in a second pixel column of the unit pixel 610 may be alternately connected to the third and fourth data lines DL3 and DL4.

The second blue sub-pixel B2 and the third red sub-pixel R3 included in a third pixel column of the unit pixel 610 may be alternately connected to the fifth and sixth data lines DL5 and DL6.

The second green sub-pixel G2 and the fourth green sub-pixel G4 included in a fourth pixel column of the unit pixel 610 may be alternately connected to the seventh and eighth data lines DL7 and DL8.

The selective output unit 300 may include a first switch group 310, a second switch group 320, a third switch group 330, and a fourth switch group 340. The selective output unit 300 may selectively connect first and second output terminals DOUT1 and DOUT2 of the data driver 200 to the first, second, third, fourth, fifth, sixth, seventh, and eighth data lines DL1, DL2, DL3, DL4, DL5, DL6, DL7, and DL8 based on first, second, third, and fourth switch control signals TG1, TG2, TG3, and TG4.

The first switch group 310 may be connected to the second data line DL2 and the third data line DL3 which are connected to the first red sub-pixel R1 and the first green sub-pixel G1 of the first pixel P1, which is an odd pixel of the first pixel row. The first switch group 310 may transmit the data voltages provided from the first and second output terminals DOUT1 and DOUT2 of the data driver 200 to the second data line DL2 and the third data line DL3 connected to the first red sub-pixel R1 and the first green sub-pixel G1 of the first pixel P1 in response to a first switch control signal TG1.

The second switch group 320 may be connected to the sixth data line DL6 and the seventh data line DL7 which are connected to the second blue sub-pixel B2 and the second green sub-pixel G2 of the second pixel P2, which is an even pixel of the first pixel row. The second switch group 320 may transmit the data voltages provided from the first and second output terminals DOUT1 and DOUT2 of the data driver 200 to the sixth data line DL6 and the seventh data line DL7 connected to the second blue sub-pixel B2 and the second green sub-pixel G2 of the second pixel P2 in response to a second switch control signal TG2.

The third switch group 330 may be connected to the fourth data line DL4 and the fifth data line DL5 which are connected to the third red sub-pixel R3 and the third green sub-pixel G3 of the third pixel P3, which is an odd pixel of the second pixel row. The third switch group 330 may transmit the data voltages provided from the first and second output terminals DOUT1 and DOUT2 of the data driver 200 to the fourth data line DL4 and the fifth data line DL5 connected to the third red sub-pixel R3 and the third green sub-pixel G3 of the third pixel P3 in response to a third switch control signal TG3.

The fourth switch group 340 may be connected to the first data line DL1 and the eighth data line DL8 which are connected to the fourth blue sub-pixel B4 and the fourth green sub-pixel G4 of the fourth pixel P4, which is an even pixel of the second pixel row. The fourth switch group 340 may transmit the data voltages provided from the first and second output terminals DOUT1 and DOUT2 of the data driver 200 to the first data line DL1 and the eighth data line DL8 connected to the fourth blue sub-pixel B4 and the fourth green sub-pixel G4 of the fourth pixel P4 in response to a fourth switch control signal TG4.

Figure 4:
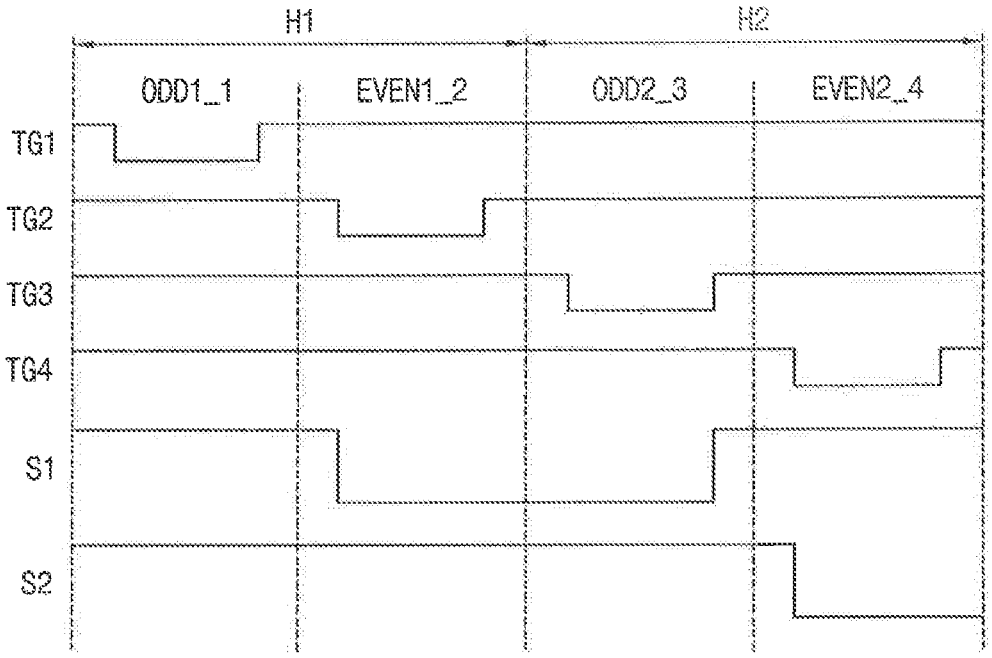
FIG. 4 is a waveform diagram for describing a method of driving a display unit according to comparative examples.
Figure 5A:
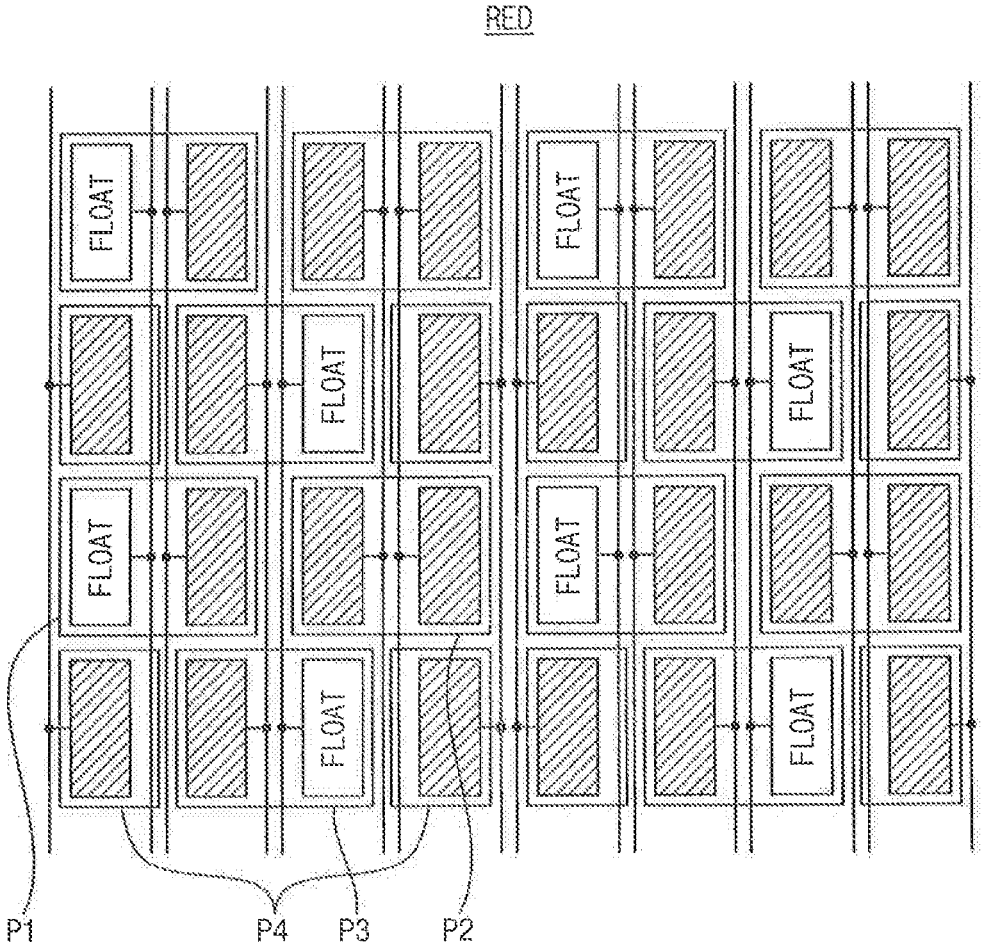
FIGS. 5A to 5C are conceptual diagrams for describing data voltages written in the display unit according to comparative examples.
Figure 5B:
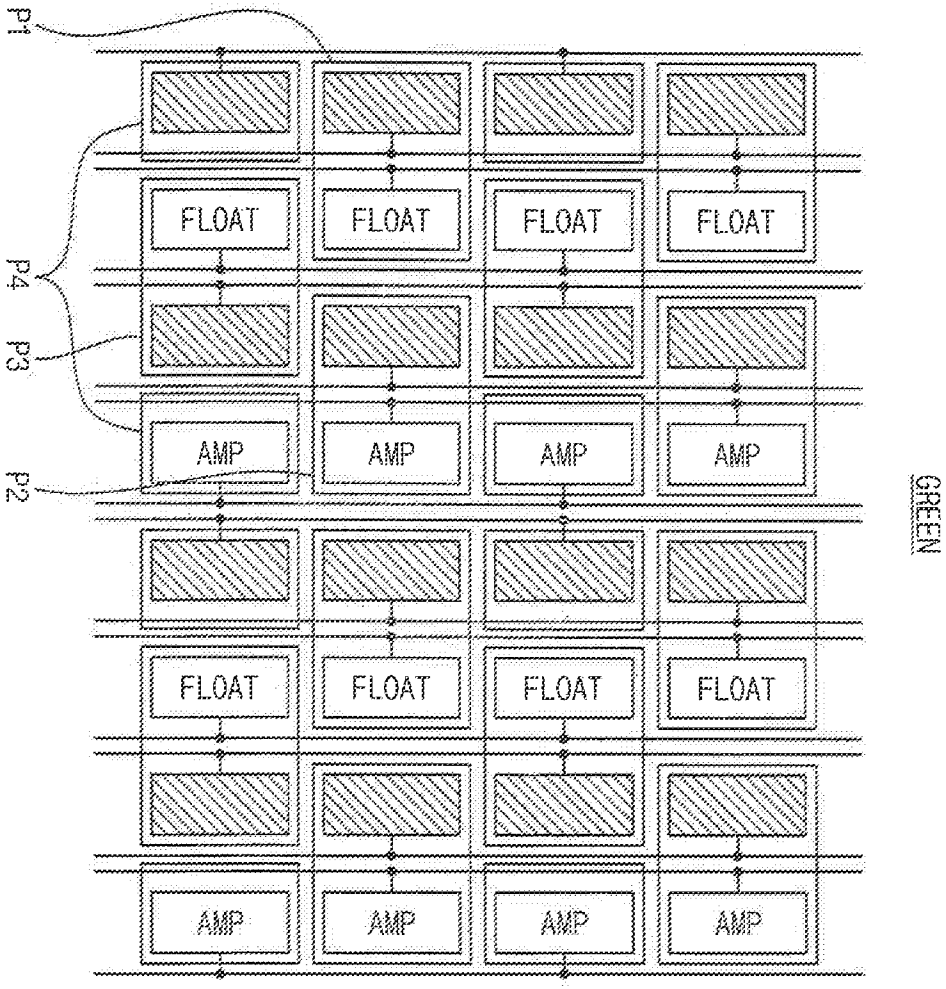
Figure 5C:
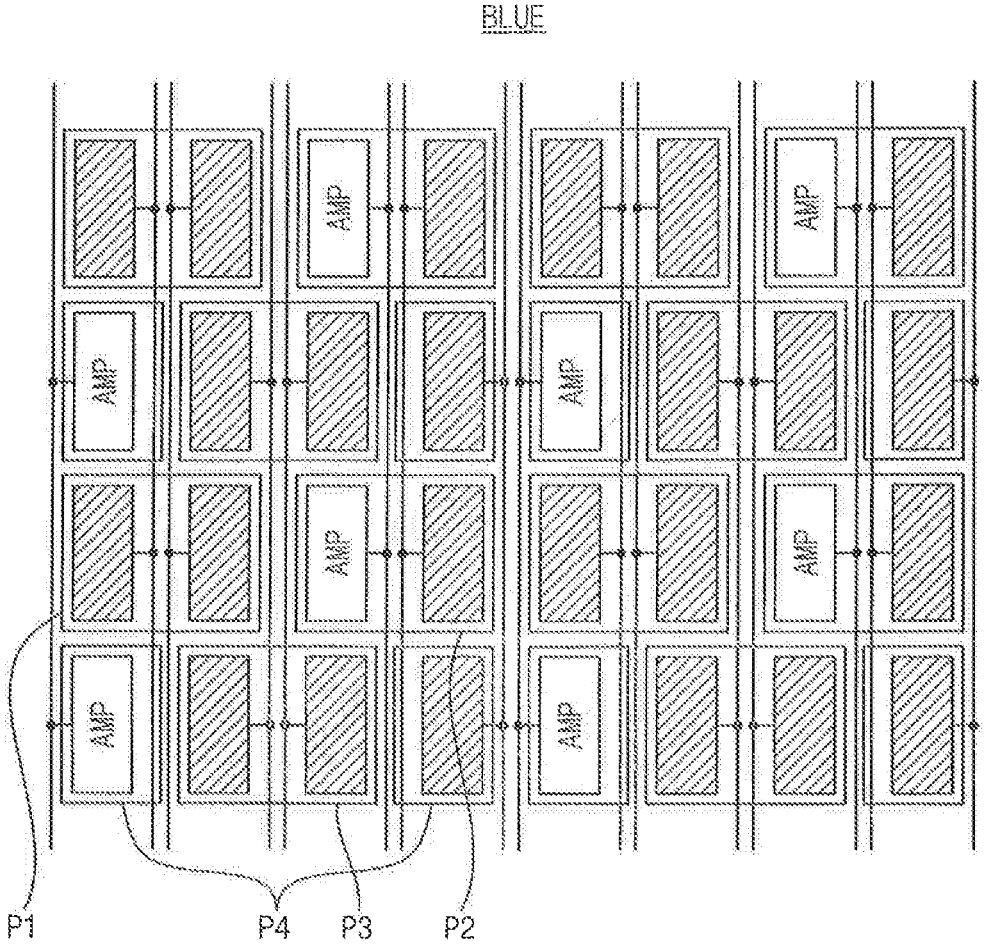

FIG. 4 is a waveform diagram for describing a method of driving a display unit according to comparative examples. FIGS. 5A to 5C are conceptual diagrams for describing data voltages written in the display unit according to comparative examples. The sub-pixel arrangement in each unit pixel 610 illustrated in FIGS. 5A to 5C corresponds to the sub-pixel arrangement illustrated in FIG. 3.

When describing the waveform diagram of FIG. 4, each horizontal period is described as including an initial section and a latter section. The latter section refers to a point in time during the horizontal period occurring after the initial section. In comparative examples, within a horizontal period, the length of the initial section may be about the same as the length of the latter section. However, the comparative examples are not limited thereto.

Referring to FIGS. 3 and 4, when the first switch control signal TG1 is applied to a first initial section ODD1_1 of a first horizontal period H1, the first switch group 310 may apply the data voltages corresponding to the first red sub-pixel R1 and the first green sub-pixel G1 of the first pixel P1 to the second data line DL2 and the third data line DL3 connected to the first red sub-pixel R1 and the first green sub-pixel G1 of the first pixel P1. The data voltages applied to the second data line DL2 and the third data line DL3 may be applied to the first red sub-pixel R1 and the first green sub-pixel G1 of the first pixel P1 while a first scan signal S1 is applied, that is, during a first latter section EVEN1_2 of the first horizontal period H1 and a second initial section ODD2_3 of a second horizontal period H2.

When the second switch control signal TG2 is applied to the first latter section EVEN1_2 of the first horizontal period H1, the second switch group 320 may apply the data voltages corresponding to the second blue sub-pixel B2 and the second green sub-pixel G2 of the second pixel P2 to the sixth data line DL6 and the seventh data line DL7 connected to the second blue sub-pixel B2 and the second green sub-pixel G2 of the second pixel P2. The data voltages applied to the sixth data line DL6 and the seventh data line DL7 may be applied to the second blue sub-pixel B2 and the second green sub-pixel G2 of the second pixel P2 while the first scan signal S1 is applied, that is, during the first latter section EVEN1_2 of the first horizontal period H1 and the second initial section ODD2_3 of the second horizontal period H2.

When the third switch control signal TG3 is applied to the second initial section ODD2_3 of the second horizontal period H2, the third switch group 330 may apply the data voltages corresponding to the third red sub-pixel R3 and the third green sub-pixel G3 of the third pixel P3 to the fourth data line DL4 and the fifth data line DL5 connected to the red sub-pixel R3 and the third green sub-pixel G3 of the third pixel P3. The data voltages applied to the fourth data line DL4 and the fifth data line DL5 may be applied to the third red sub-pixel R3 and the third green sub-pixel G3 of the third pixel P3 while a second scan signal S2 is applied, that is, during a second latter section EVEN2_4 of the second horizontal period H2 and a third initial section of a third horizontal period.

When the fourth switch control signal TG4 is applied to the second latter section EVEN2_4 of the second horizontal period H2, the fourth switch group 340 may apply the data voltages corresponding to the fourth blue sub-pixel B4 and the fourth green sub-pixel G4 of the fourth pixel P4 to the first data line DL1 and the eighth data line DL8 connected to the fourth blue sub-pixel B4 and the fourth green sub-pixel G4 of the fourth pixel P4. The data voltages applied to the first data line DL1 and the eighth data line DL8 may be applied to the fourth blue sub-pixel B4 and the fourth green sub-pixel G4 of the fourth pixel P4 while the second scan signal S2 is applied, that is, during the second latter section EVEN2_4 of the second horizontal period H2 and the third initial section of the third horizontal period.

The first scan signal S1 is applied to the sub-pixels of the first pixel row for one horizontal period from the first latter section EVEN1_2 of the first horizontal period H1, and the second scan signal S2 is applied to the sub-pixels of the second pixel row for one horizontal period from the second latter section EVEN2_4 of the second horizontal period H2.

Each of the first and second scan signals S1 and S2 is a scan signal applied to the gate electrodes of the second transistor T2 and the third transistor T3 included in the pixel circuit of FIG. 2.

Referring to the first scan signal S1, the first scan signal S1 is deactivated in the first initial section ODD1_1 of the first horizontal period H1, and the first scan signal S1 is activated in the first latter section EVEN1_2 of the first horizontal period H1.

Due to the first scan signal S1 activated in the first latter section EVEN1_2 of the first horizontal period H1, the first pixel P1 to which the data voltages of the second and third data lines DL2 and DL3 are applied in the first initial section ODD1_1 of the first horizontal period H1 may store (or receive) the data voltages provided from the second and third data lines DL2 and DL3 in a floating state with the data driver 200, and the second pixel P2 to which the data voltages of the sixth and seventh data lines DL6 and DL7 are applied in the first latter section EVEN1_2 of the first horizontal period H1 may store the data voltages provided through the sixth and seventh data lines DL6 and DL7 in a connection state with the data driver 200.

Accordingly, the first red sub-pixel R1 and the first green sub-pixel G1 of the first pixel P1 may store the data voltage in the floating state (e.g., during an entire scan-on time, for example, during the first latter section EVEN1_2 and the second initial section ODD2_3), and the second blue sub-pixel B2 and the second green sub-pixel G2 of the second pixel P2 may store the data voltage in the connection state (e.g., during at least a part of the scan-on time, for example, during the first latter section EVEN1_2).

In addition, the second scan signal S2 may be applied to the sub-pixels of the second pixel row for one horizontal period from the second latter section EVEN2_4 of the second horizontal period H2.

Referring to the second scan signal S2, the second scan signal S2 is deactivated in the second initial section ODD2_3 of the second horizontal period H2, and is activated in the second latter section EVEN2_4 of the second horizontal period H2.

Due to the second scan signal S2 activated in the second latter section EVEN2_4 of the second horizontal period H2, the third pixel P3 to which the data voltages of the fourth and fifth data lines DL4 and DL5 are applied in the second initial section ODD2_3 of the second horizontal period H2 may store the data voltages provided from the fourth and fifth data lines DL4 and DL5 in the floating state with the data driver 200, and the fourth pixel P4 to which the data voltages of the first and eighth data lines DL1 and DL8 are applied in the second latter section EVEN2_4 of the second horizontal period H2 may store the data voltages provided through the first and eighth data lines DL1 and DL8 in the connection state with the data driver 200.

Accordingly, the third red sub-pixel R3 and the third green sub-pixel G3 of the third pixel P3 may store the data voltage in the floating state (e.g., during the entire scan-on time for example, the second latter section EVEN2_4 and the third initial section), and the fourth blue sub-pixel B4 and the fourth green sub-pixel G4 of the fourth pixel P4 may store the data voltage in the connection state (e.g., during at least a part of the scan-on time, for example, the second latter section EVEN2_4).

Referring to FIGS. 3, 4 and 5A, to display a red image on the display unit 600, a white voltage is applied to the red sub-pixel, and a black voltage is applied to the green and blue sub-pixels.

The red sub-pixel is included in the first and third pixels P1 and P3.

The data voltage is applied to the data line connected to the first pixel P1 in the first initial section ODD1_1 of the first horizontal period H1, and the data voltage is applied to the data line connected to the third pixel P3 in the second initial section ODD2_3 of the second horizontal period H2. Accordingly, all of the red sub-pixels included in the first and third pixels P1 and P3 may store the data voltage in the floating state (e.g., during the entire scan-on time).

Therefore, all of the red sub-pixels of the display unit have a floating stored voltage FLOAT, and the luminance quality of the red image may be excellent.

Referring to FIGS. 3, 4 and 5B, to display a green image on the display unit, a white voltage is applied to the green sub-pixels of the display unit, and a black voltage is applied to the red and blue sub-pixels.

The green sub-pixel is included in the first, second, third, and fourth pixels P1, P2, P3, and P4.

The data voltage is applied to the data line connected to the first pixel P1 in the first initial section ODD1_1 of the first horizontal period H1, and the data voltage is applied to the data line connected to the second pixel P2 in the first latter section EVEN1_2 of the first horizontal period H1.

The data voltage is applied to the data line connected to the third pixel P3 in the second initial section ODD2_3 of the second horizontal period H2, and the data voltage is applied to the data line connected to the fourth pixel P4 in the second latter section EVEN2_4 of the second horizontal period H2.

Accordingly, all of the green sub-pixels included in the first and third pixels P1 and P3 may store the data voltage in the floating state (e.g., during the entire scan-on time), and all of the green sub-pixels included in the second and fourth pixels P2 and P4 may store the data voltage in the connection state (e.g., during at least a part of the scan-on time).

Therefore, according to the green sub-pixels of the display unit 600, an unintended vertical line is visible in the green image due to a voltage difference between the floating stored voltage FLOAT and a connection stored voltage AMP.

Referring to FIGS. 3, 4 and 5C, to display a blue image on the display unit, a white voltage is applied to the blue sub-pixels, and a black voltage is applied to the red and green sub-pixels.

The blue sub-pixel is included in the second and fourth pixels P2 and P4.

The data voltage is applied to the data line connected to the second pixel P2 in the first latter section EVEN1_2 of the first horizontal period H1, and the data voltage is applied to the data line connected to the fourth pixel P4 in the second latter section EVEN2_4 of the second horizontal period H2. Accordingly, all of the blue sub-pixels included in the second and fourth pixels P2 and P4 may store the data voltage in the connection state (e.g., at least a part of the scan-on time).

Therefore, all of the blue sub-pixels of the display unit 600 have the connection stored voltage AMP, and the luminance quality of the blue image may be excellent.

As described above, in a comparative example, an unintended vertical line may be visible due to the voltage difference in the stored voltages in a green component having the highest influence on the luminance, thereby decreasing the display quality.

In an exemplary embodiment, the display failure due to the difference in the data voltages stored in the sub-pixels can be improved.

According to exemplary embodiments, the defective luminance due to the difference in the stored voltages can be improved by uniformly distributing the floating state and the connection state of the voltages stored in the first, second, third, and fourth pixels P1, P2, P3, and P4 of the unit pixel 610.

Figure 6:
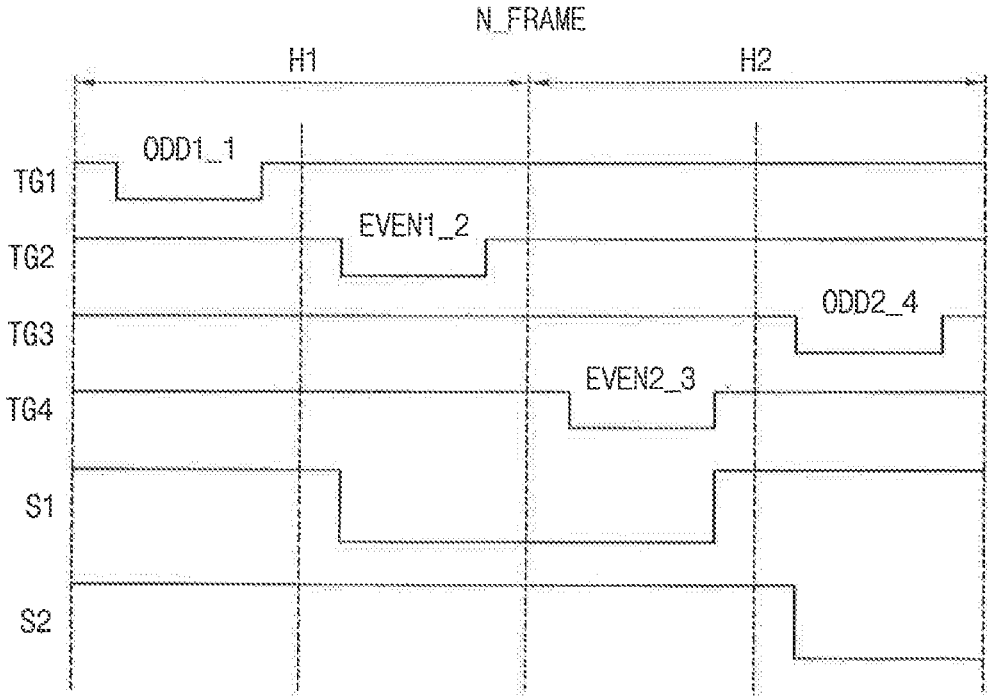
FIG. 6 is a waveform diagram for describing a method of driving a display unit during an $N^{th}$ frame according to exemplary embodiments.
Figure 7A:
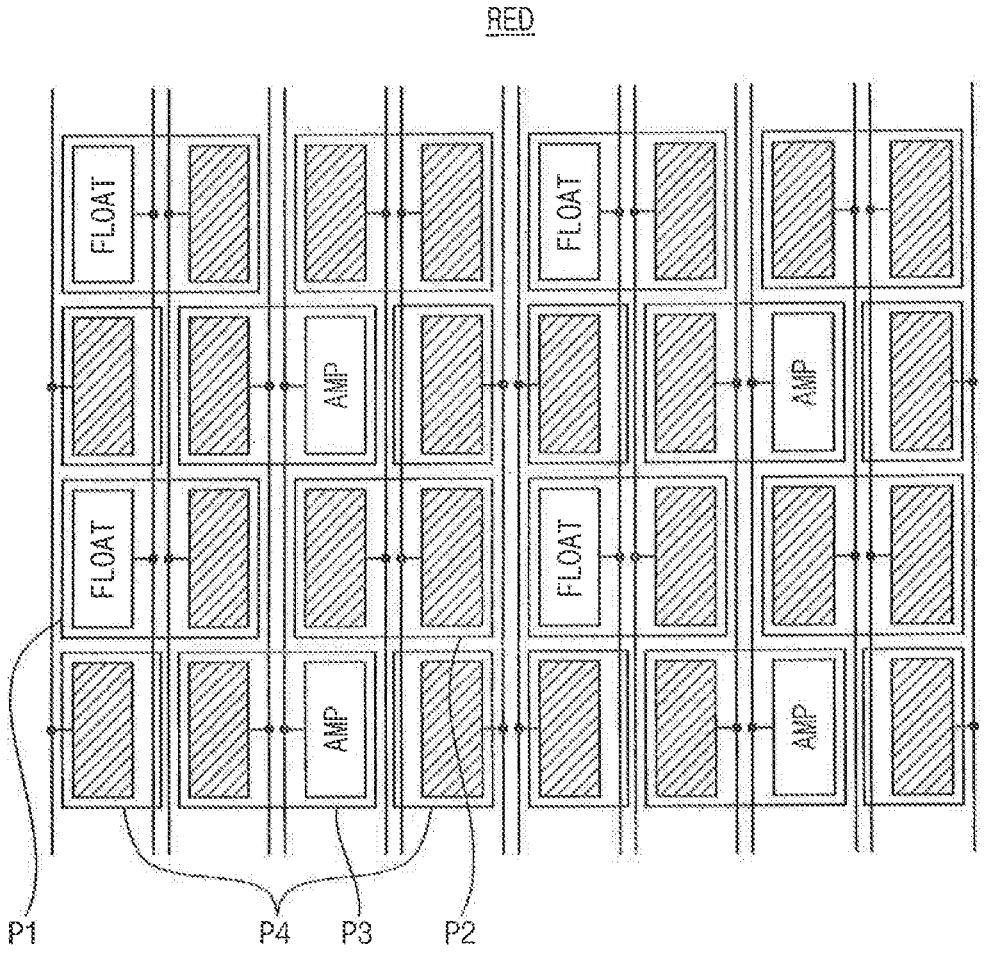
FIGS. 7A to 7C are conceptual diagrams for describing data voltages written in the display unit during an $N^{th}$ frame according to exemplary embodiments.
Figure 7B:
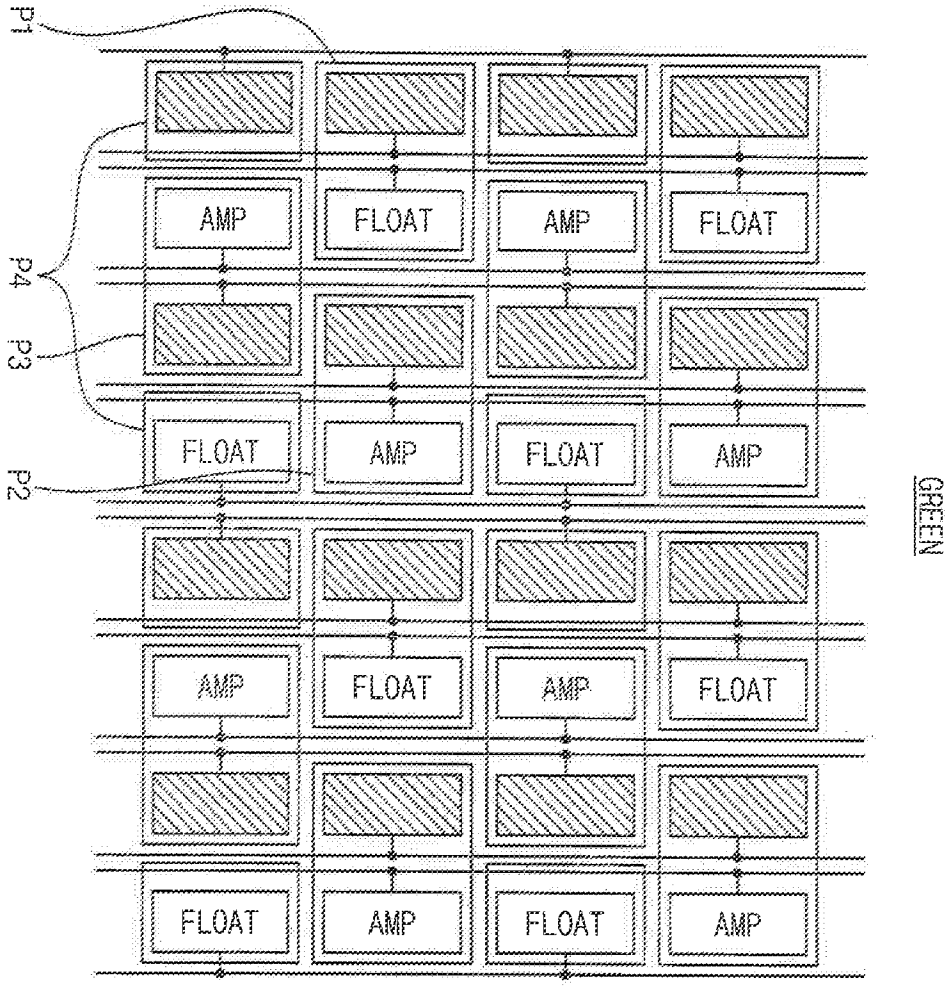
Figure 7C:
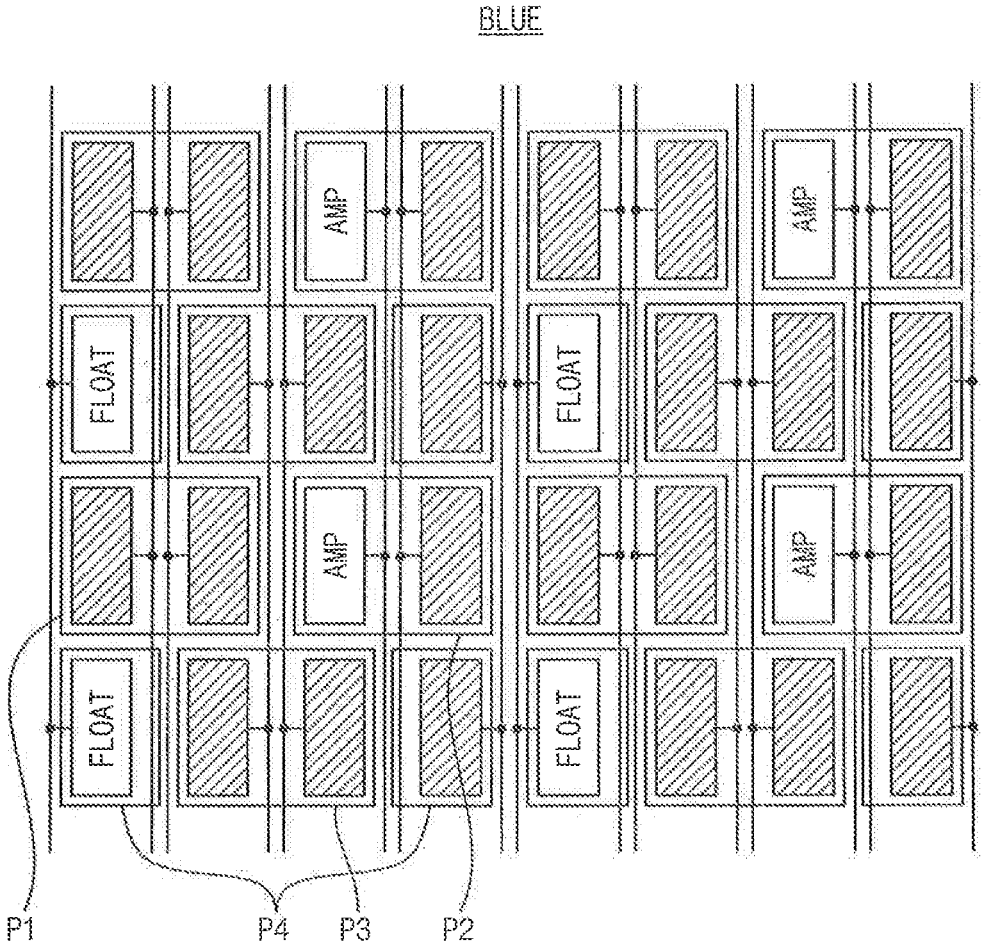

FIG. 6 is a waveform diagram for describing a method of driving a display unit during an $N^{th}$ frame according to exemplary embodiments. FIGS. 7A to 7C are conceptual diagrams for describing data voltages written in the display unit during an $N^{th}$ frame according to exemplary embodiments. The sub-pixel arrangement in each unit pixel 610 illustrated in FIGS. 7A to 7C corresponds to the sub-pixel arrangement illustrated in FIG. 3.

When describing the waveform diagram of FIG. 6, each horizontal period is described as including an initial section and a latter section. The latter section refers to a point in time during the horizontal period occurring after the initial section. In exemplary embodiments, within a horizontal period, the length of the initial section may be about the same as the length of the latter section. However, the exemplary embodiments are not limited thereto.

Referring to FIGS. 3 and 6, a method of driving the display unit 600 during an $N^{th}$ frame N_FRAME according to exemplary embodiments will be described, in which N is a positive integer.

When the first switch control signal TG1 is applied to the first initial section ODD1_1 of the first horizontal period H1, the first switch group 310 may apply the data voltages corresponding to the first red sub-pixel R1 and the first green sub-pixel G1 of the first pixel P1 to the second data line DL2 and the third data line DL3 connected to the first red sub-pixel R1 and the first green sub-pixel G1 of the first pixel P1. Thus, the selective output unit 300 may output the data voltage of the first pixel P1 in the first initial section ODD1_1 of the first horizontal period H1.

When the second switch control signal TG2 is applied to the first latter section EVEN1_2 of the first horizontal period H1, the second switch group 320 may apply the data voltages corresponding to the second blue sub-pixel B2 and the second green sub-pixel G2 of the second pixel P2 to the sixth data line DL6 and the seventh data line DL7 connected to the second blue sub-pixel B2 and the second green sub-pixel G2 of the second pixel P2. Thus, the selective output unit 300 may output the data voltage of the second pixel P2 in the first latter section EVEN1_2 of the first horizontal period H1.

The first scan signal S1 is deactivated in the first initial section ODD1_1 of the first horizontal period H1, and is activated in the first latter section EVEN1_2 of the first horizontal period H1. The first scan signal S1 may be output by the scan driver 400 to the first pixel P1 and the second pixel P2. The first scan signal S1 may be activated for one horizontal period beginning from the first latter section EVEN1_2 of the first horizontal period H1.

Due to the first scan signal S1 activated in the first latter section EVEN1_2 of the first horizontal period H1, the first pixel P1 to which the data voltages of the second and third data lines DL2 and DL3 are applied in the first initial section ODD1_1 of the first horizontal period H1 may store the data voltages provided from the second and third data lines DL2 and DL3 in the floating state with the data driver 200, and the second pixel P2 to which the data voltages of the sixth and seventh data lines DL6 and DL7 are applied in the first latter section EVEN1_2 of the first horizontal period H1 may store the data voltages provided through the sixth and seventh data lines DL6 and DL7 in the connection state with the data driver 200.

Accordingly, the first red sub-pixel R1 and the first green sub-pixel G1 of the first pixel P1 may store the data voltage in the floating state, the second blue sub-pixel B2 and the second green sub-pixel G2 of the second pixel P2 may store the data voltage in the connection state.

When the fourth switch control signal TG4 is applied to a second initial section EVEN2_3 of the second horizontal period H2, the fourth switch group 340 may apply the data voltages corresponding to the fourth blue sub-pixel B4 and the fourth green sub-pixel G4 of the fourth pixel P4 to the first data line DL1 and the eighth data line DL8 connected to the fourth blue sub-pixel B4 and the fourth green sub-pixel G4 of the fourth pixel P4. Thus, the selective output unit 300 may output the data voltage of the fourth pixel P4 in the second initial section EVEN2_3 of the second horizontal period H2.

When the third switch control signal TG3 is applied to a second latter section ODD2_4 of the second horizontal period H2, the third switch group 330 may apply the data voltages corresponding to the third red sub-pixel R3 and the third green sub-pixel G3 of the third pixel P3 to the fourth data line DL4 and the fifth data line DL5 connected to the red sub-pixel R3 and the third green sub-pixel G3 of the third pixel P3. Thus, the selective output unit 300 may output the data voltage of the third pixel P3 in the second latter section ODD2_4 of the second horizontal period H2.

The second scan signal S2 is deactivated in the second initial section EVEN2_3 of the second horizontal period H2, and is activated in the second latter section ODD2_4 of the second horizontal period H2. As shown in FIG. 6, the second scan signal S2 is delayed from the first scan signal S1. For example, the second scan signal S2 is activated after the first scan signal S1 is activated. The second scan signal S2 may be output by the scan driver 400 to the third pixel P3 and the fourth pixel P4. The second scan signal S2 may be activated for one horizontal period beginning from the second latter section ODD2_4 of the second horizontal period H2, which is consecutive to the first horizontal period H1 (e.g., which occurs directly after the first horizontal period H1).

Due to the second scan signal S2 activated in the second latter section ODD2_4 of the second horizontal period H2, the fourth pixel P4 to which the data voltages of the first and eighth data lines DL1 and DL8 are applied in the second initial section EVEN2_3 of the second horizontal period H2 may store the data voltages provided from the fourth and fifth data lines DL4 and DL5 in the floating state with the data driver 200, and the fourth pixel P4 to which the data voltages of the first and eighth data lines DL1 and DL8 are applied in the second latter section ODD2_4 of the second horizontal period H2 may store the data voltages provided through the first and eighth data lines DL1 and DL8 in the connection state with the data driver 200.

Accordingly, the third red sub-pixel R3 and the third green sub-pixel G3 of the third pixel P3 may store the data voltage in the connection state, and the fourth blue sub-pixel B4 and the fourth green sub-pixel G4 of the fourth pixel P4 may store the data voltage in the floating state.

Referring to FIGS. 6 and 7A, the data voltages in the red sub-pixels written in the display unit during the $N^{th}$ frame will be described.

The red sub-pixel is included in the first and third pixels P1 and P3.

The data voltage is applied to the data line connected to the first pixel P1 in the first initial section ODD1_1 of the first horizontal period H1, and the data voltage is applied to the data line connected to the third pixel P3 in the second latter section ODD2_4 of the second horizontal period H2. Accordingly, the first red sub-pixel R1 included in the first pixel P1 may store the data voltage in the floating state, and the third red sub-pixel R3 included in the third pixel P3 may store the data voltage in the connection state.

As shown in FIG. 7A, the red sub-pixel having the floating stored voltage FLOAT and the red sub-pixel having the connection stored voltage AMP may be uniformly distributed in a zigzag manner. Therefore, unlike the comparative examples, an unintended vertical line is not visible due to the voltage difference between the floating stored voltage FLOAT and the connection stored voltage AMP in exemplary embodiments.

Referring to FIGS. 6 and 7B, the data voltages in the green sub-pixels written in the display unit during the $N^{th}$ frame will be described.

The green sub-pixel is included in the first, second, third, and fourth pixels P1, P2, P3, and P4.

The data voltage is applied to the data line connected to the first pixel P1 in the first initial section ODD1_1 of the first horizontal period H1, and the data voltage is applied to the data line connected to the second pixel P2 in the first latter section EVEN1_2 of the first horizontal period H1.

The data voltage is applied to the data line connected to the third pixel P3 in the second latter section ODD2_4 of the second horizontal period H2, and the data voltage is applied to the data line connected to the fourth pixel P4 in the second initial section EVEN2_3 of the second horizontal period H2.

Accordingly, the green sub-pixels included in the first and fourth pixels P1 and P4 may store the data voltage in the floating state, and the green sub-pixels included in the second and third pixels P2 and P3 may store the data voltage in the connection state.

As shown in FIG. 7B, the green sub-pixels included in a pixel column and having the floating stored voltage FLOAT and the connection stored voltage AMP may be alternately and uniformly distributed. Therefore, unlike the comparative examples, an unintended vertical line is not visible due to the voltage difference between the floating stored voltage FLOAT and the connection stored voltage AMP according to exemplary embodiments.

Referring to FIGS. 6 and 7C, the data voltages in the blue sub-pixels written in the display unit during the $N^{th}$ frame will be described.

The blue sub-pixel is included in the second and fourth pixels P2 and P4.

The data voltage is applied to the data line connected to the second pixel P2 in the first latter section EVEN1_2 of the first horizontal period H1, and the data voltage is applied to the data line connected to the fourth pixel P4 in the second initial section EVEN2_3 of the second horizontal period H2. Accordingly, the second blue sub-pixel B2 included in the second pixel P2 may store the data voltage in the connection state, and the fourth blue sub-pixel B4 included in the fourth pixel P4 may store the data voltage in the floating state.

As shown in FIG. 7C, the blue sub-pixel having the floating stored voltage FLOAT and the blue sub-pixel having the connection stored voltage AMP may be uniformly distributed in a zigzag manner. Therefore, unlike the comparative examples, an unintended vertical line is not visible due to the voltage difference between the floating stored voltage FLOAT and the connection stored voltage AMP according to exemplary embodiments.

As described above, during the $N^{th}$ frame N_FRAME, the display quality of the red image, the green image, and the blue image displayed on the display unit 600 can be improved according to exemplary embodiments.

Figure 8:
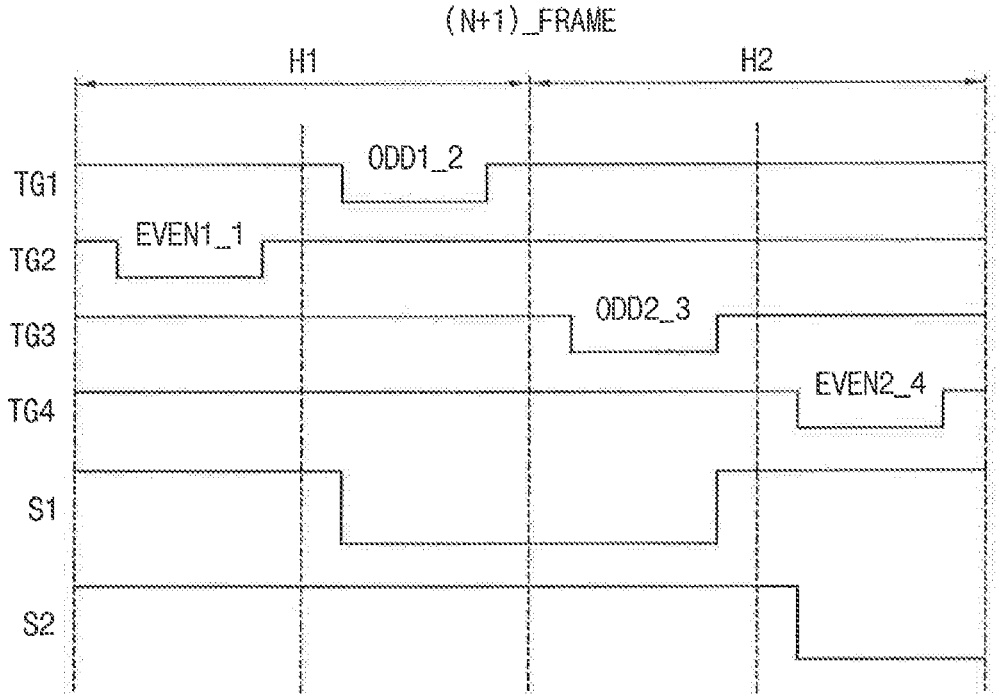
FIG. 8 is a waveform diagram for describing a method of driving a display unit during an $(N+1)^{th}$ frame according to exemplary embodiments.
Figure 9A:
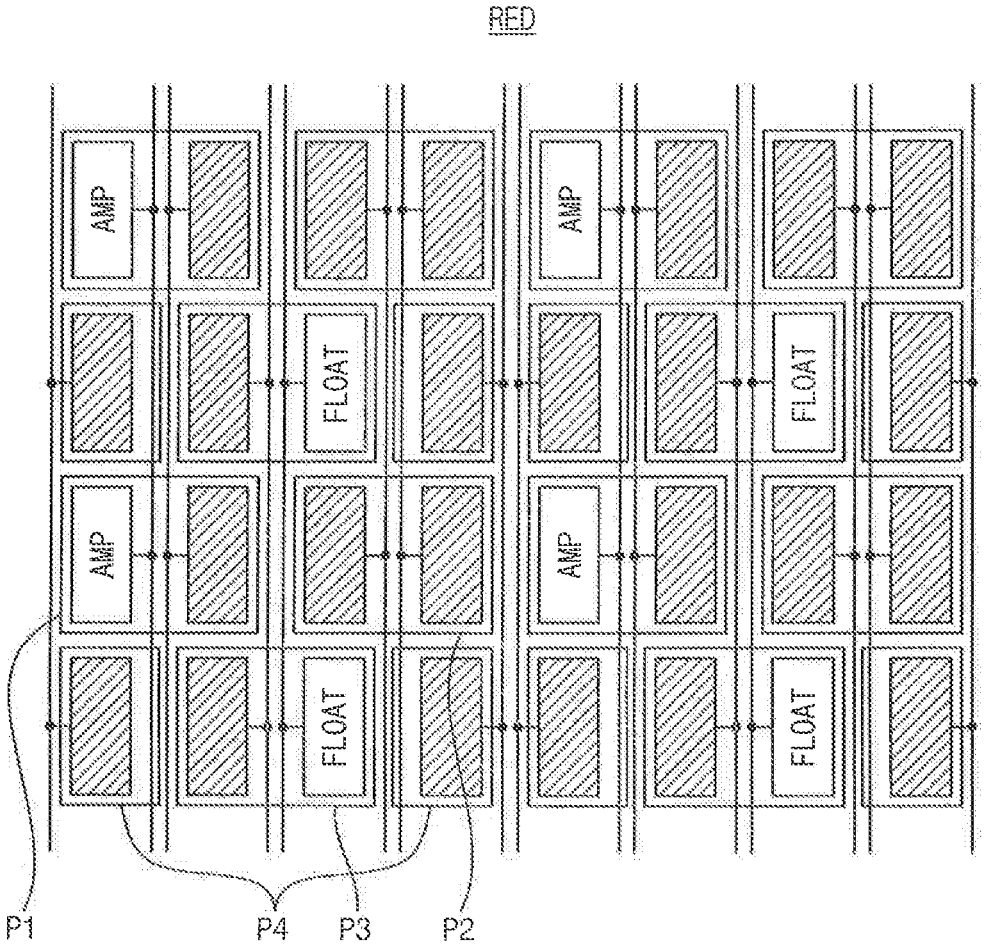
FIGS. 9A to 9C are conceptual diagrams for describing data voltages written in the display unit during the $(N+1)^{th}$ frame according to exemplary embodiments.
Figure 9B:
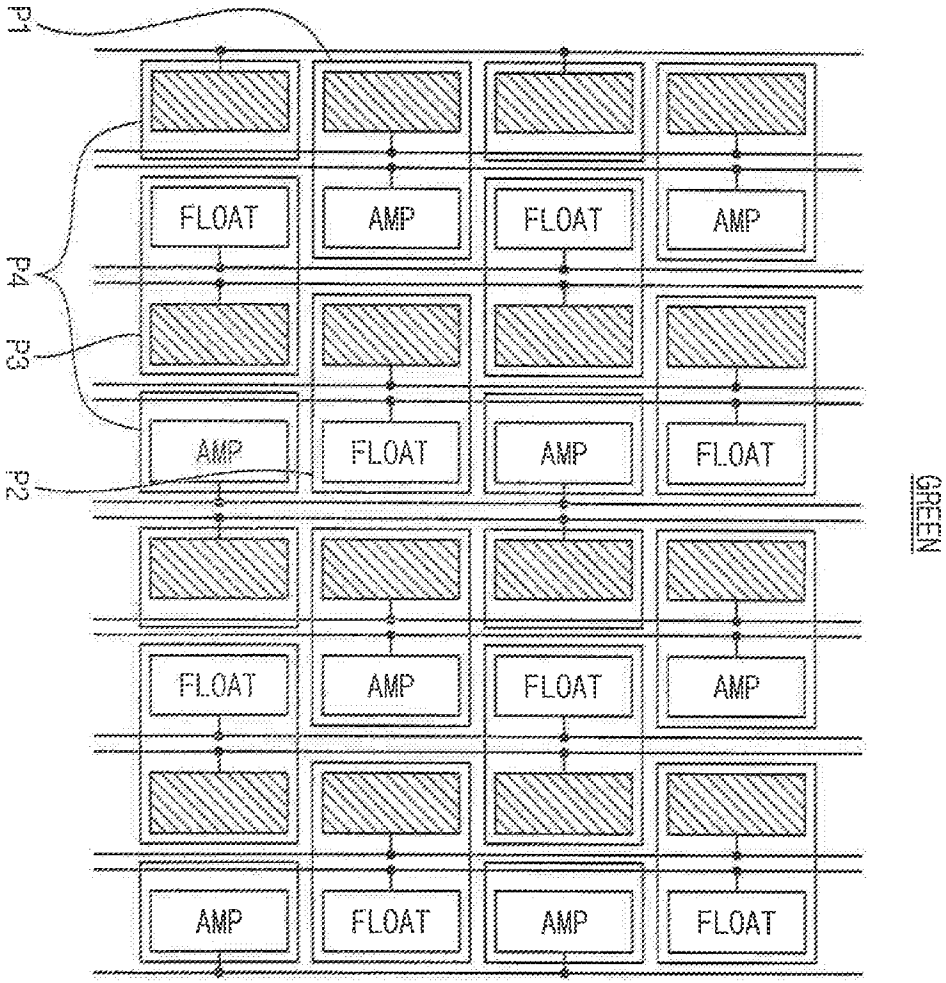
Figure 9C:
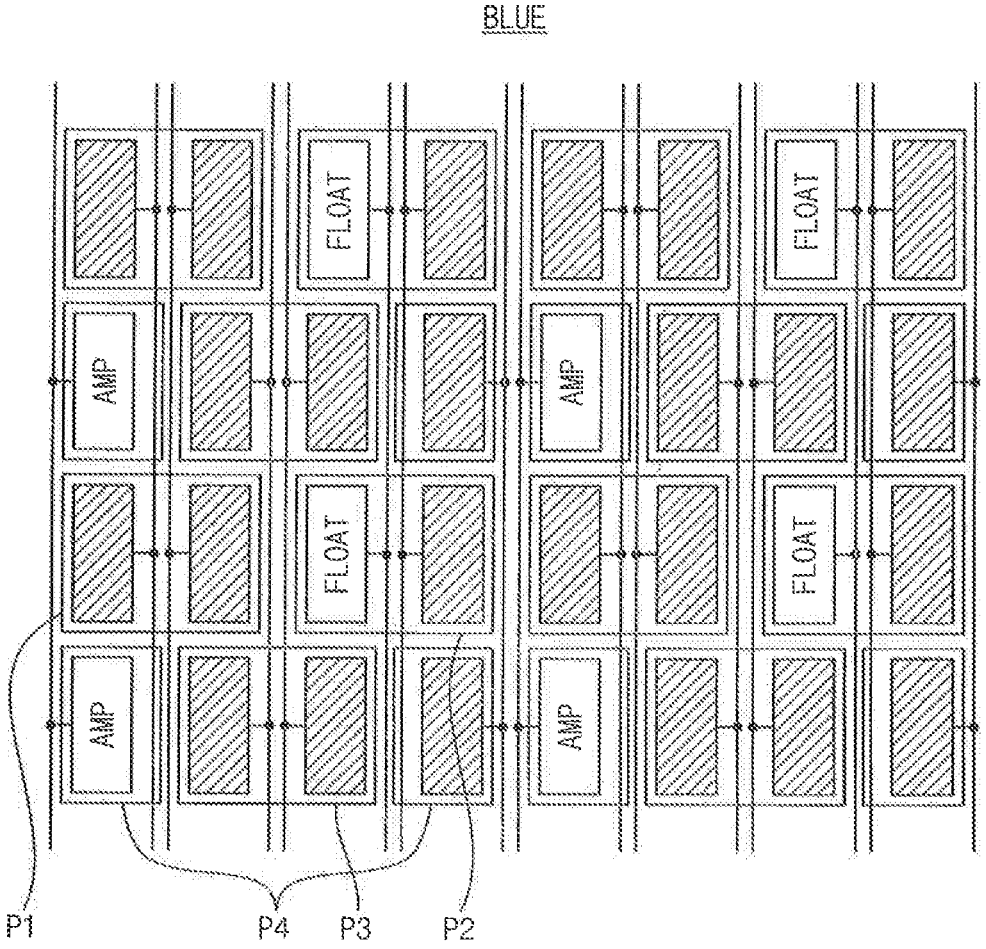

FIG. 8 is a waveform diagram for describing a method of driving a display unit during an $(N+1)^{th}$ frame according to exemplary embodiments, in which N is a positive integer. FIGS. 9A to 9C are conceptual diagrams for describing data voltages written in the display unit during the $(N+1)^{th}$ frame according to exemplary embodiments. The sub-pixel arrangement in each unit pixel 610 illustrated in FIGS. 9A to 9C corresponds to the sub-pixel arrangement illustrated in FIG. 3.

When describing the waveform diagram of FIG. 8, each horizontal period is described as including an initial section and a latter section. The latter section refers to a point in time during the horizontal period occurring after the initial section. In exemplary embodiments, within a horizontal period, the length of the initial section may be about the same as the length of the latter section. However, the exemplary embodiments are not limited thereto.

Referring to FIGS. 3 and 8, the method of driving the display unit 600 during the $(N+1)^{th}$ frame (N+1) FRAME will be described.

When the second switch control signal TG2 is applied to a first initial section EVEN1_1 of the first horizontal period H1, the second switch group 320 may apply the data voltages corresponding to the second blue sub-pixel B2 and the second green sub-pixel G2 of the second pixel P2 to the sixth data line DL6 and the seventh data line DL7 connected to the second blue sub-pixel B2 and the second green sub-pixel G2 of the second pixel P2. Thus, the selective output unit 300 may output the data voltage of the second pixel P2 in the first initial section EVEN1_1 of the first horizontal period H1.

When the first switch control signal TG1 is applied to a first latter section ODD1_2 of the first horizontal period H1, the first switch group 310 may apply the data voltages corresponding to the first red sub-pixel R1 and the first green sub-pixel G1 of the first pixel P1 to the second data line DL2 and the third data line DL3 connected to the first red sub-pixel R1 and the first green sub-pixel G1 of the first pixel P1. Thus, the selective output unit 300 may output the data voltage of the first pixel P1 in the first latter section ODD1_2 of the first horizontal period H1.

The first scan signal S1 is deactivated in the first initial section EVEN1_1 of the first horizontal period H1, and is activated in the first latter section ODD1_2 of the first horizontal period H1. The first scan signal S1 may be output by the scan driver 400 to the first pixel P1 and the second pixel P2. The first scan signal S1 may be activated for one horizontal period beginning from the first latter section ODD1_2 of the first horizontal period H1.

Due to the first scan signal S1 activated in the first latter section ODD1_2 of the first horizontal period H1, the second pixel P2 to which the data voltages of the sixth and seventh data lines DL6 and DL7 are applied in the first initial section EVEN1_1 of the first horizontal period H1 may store the data voltages provided from the sixth and seventh data lines DL6 and DL7 in the floating state with the data driver 200, and the first pixel P1 to which the data voltages of the second and third data lines DL2 and DL3 are applied in the first latter section ODD1_2 of the first horizontal period H1 may store the data voltages provided through the second and third data lines DL2 and DL3 in the connection state with the data driver 200.

Accordingly, the first red sub-pixel R1 and the first green sub-pixel G1 of the first pixel P1 may store the data voltage in the connection state, and the second blue sub-pixel B2 and the second green sub-pixel G2 of the second pixel P2 may store the data voltage in the floating state.

When the third switch control signal TG3 is applied to the second initial section ODD2_3 of the second horizontal period H2, the third switch group 330 may apply the data voltages corresponding to the third red sub-pixel R3 and the third green sub-pixel G3 of the third pixel P3 to the fourth data line DL4 and the fifth data line DL5 connected to the third red sub-pixel R3 and the third green sub-pixel G3 of the third pixel P3. Thus, the selective output unit 300 may output the data voltage of the third pixel P3 in the second initial section ODD2_3 of the second horizontal period H2.

When the fourth switch control signal TG4 is applied to the second latter section EVEN2_4 of the second horizontal period H2, the fourth switch group 340 may apply the data voltages corresponding to the fourth blue sub-pixel B4 and the fourth green sub-pixel G4 of the fourth pixel P4 to the first data line DL1 and the eighth data line DL8 connected to the fourth blue sub-pixel B4 and the fourth green sub-pixel G4 of the fourth pixel P4. Thus, the selective output unit 300 may output the data voltage of the fourth pixel P4 in the second latter section EVEN2_4 of the second horizontal period H2.

The second scan signal S2 is deactivated in the second initial section ODD2_3 of the second horizontal period H2, and is activated in the second latter section EVEN2_4 of the second horizontal period H2. As shown in FIG. 8, the second scan signal S2 is delayed from the first scan signal S1. For example, the second scan signal S2 is activated after the first scan signal S1 is activated. The second scan signal S2 may be output by the scan driver 400 to the third pixel P3 and the fourth pixel P4. The second scan signal S2 may be activated for one horizontal period beginning from the second latter section EVEN2_4 of the second horizontal period H2, which is consecutive to the first horizontal period H1 (e.g., which occurs directly after the first horizontal period H1).

Due to the second scan signal S2 activated in the second latter section EVEN2_4 of the second horizontal period H2, the third pixel P3 to which the data voltages of the fourth and fifth data lines DL4 and DL5 are applied in the second initial section ODD2_3 of the second horizontal period H2 may store the data voltages provided from the fourth and fifth data lines DL4 and DL5 in the floating state with the data driver 200, and the fourth pixel P4 to which the data voltages of the first and eighth data lines DL1 and DL8 are applied in the second latter section EVEN2_4 of the second horizontal period H2 may store the data voltages provided through the first and eighth data lines DL1 and DL8 in the connection state with the data driver 200.

Accordingly, the third red sub-pixel R3 and the third green sub-pixel G3 of the third pixel P3 may store the data voltage in the floating state, and the fourth blue sub-pixel B4 and the fourth green sub-pixel G4 of the fourth pixel P4 may store the data voltage in the connection state.

Referring to FIGS. 8 and 9A, the data voltages in the red sub-pixels written in the display unit during the $(N+1)^{th}$ frame will be described.

The red sub-pixel is included in the first and third pixels P1 and P3.

The data voltage is applied to the data line connected to the first pixel P1 in the first latter section ODD1_2 of the first horizontal period H1, and the data voltage is applied to the data line connected to the third pixel P3 in the second initial section ODD2_3 of the second horizontal period H2. Accordingly, the first red sub-pixel R1 included in the first pixel P1 may store the data voltage in the connection state, and the third red sub-pixel R3 included in the third pixel P3 may store the data voltage in the floating state.

As shown in FIG. 9A, the red sub-pixel having the floating stored voltage FLOAT and the red sub-pixel having the connection stored voltage AMP may be uniformly distributed in a zigzag manner. Therefore, unlike the comparative examples, an unintended vertical line is not visible due to the voltage difference between the floating stored voltage FLOAT and the connection stored voltage AMP according to exemplary embodiments.

Referring to FIGS. 8 and 9B, the data voltages in the green sub-pixels written in the display unit during the $(N+1)^{th}$ frame will be described.

The green sub-pixel is included in the first, second, third, and fourth pixels P1, P2, P3, and P4.

The data voltage is applied to the data line connected to the first pixel P1 in the first latter section ODD1_2 of the first horizontal period H1, and the data voltage is applied to the data line connected to the second pixel P2 in the first initial section EVEN1_1 of the first horizontal period H1.

The data voltage is applied to the data line connected to the third pixel P3 in the second initial section ODD2_3 of the second horizontal period H2, and the data voltage is applied to the data line connected to the fourth pixel P4 in the second latter section EVEN2_4 of the second horizontal period H2.

Accordingly, the green sub-pixels included in the first and fourth pixels P1 and P4 may store the data voltage in the connection state, and the green sub-pixels included in the second and third pixels P2 and P3 may store the data voltage in the floating state.

As shown in FIG. 9B, the green sub-pixels included in a pixel column and having the floating stored voltage FLOAT and the connection stored voltage AMP may be alternately and uniformly distributed. Therefore, unlike the comparative examples, an unintended vertical line is not visible due to the voltage difference between the floating stored voltage FLOAT and the connection stored voltage AMP according to exemplary embodiments.

Referring to FIGS. 8 and 9C, the data voltages in the blue sub-pixels written in the display unit during the $(N+1)^{th}$ frame will be described.

The blue sub-pixel is included in the second and fourth pixels P2 and P4.

The data voltage is applied to the data line connected to the second pixel P2 in the first initial section EVEN1_1 of the first horizontal period H1, and the data voltage is applied to the data line connected to the fourth pixel P4 in the second latter section EVEN2_4 of the second horizontal period H2. Accordingly, the second blue sub-pixel B2 included in the second pixel P2 may store the data voltage in the floating state, and the fourth blue sub-pixel B4 included in the fourth pixel P4 may store the data voltage in the connection state.

As shown in FIG. 9C, the blue sub-pixel having the floating stored voltage FLOAT and the blue sub-pixel having the connection stored voltage AMP may be uniformly distributed in a zigzag manner. Therefore, unlike the comparative examples, an unintended vertical line is not visible due to the voltage difference between the floating stored voltage FLOAT and the connection stored voltage AMP according to exemplary embodiments.

As described above, during the $(N+1)^{th}$ frame N_FRAME, the display quality of the red image, the green image, and the blue image displayed on the display unit can be improved according to exemplary embodiments.

According to exemplary embodiments as described above, in a display device and a method of driving the same according to exemplary embodiments, the display device has a pentile sub-pixel structure, a demux structure for reducing an output terminal of a data driver, and a two data line structure in which sub-pixels included in one pixel column are alternately driven by using two data lines to extend a data writing time and a compensation time of a pixel, in which an order of switches of the demux and an output of a data voltage corresponding to the order of switches are controlled. As a result, a display failure due to a time difference of data voltages stored in the pixel can be improved.

Exemplary embodiments of the present invention may be applied to a display device (e.g., an organic light emitting display device). For example, exemplary embodiments of the present invention may be applied to a computer, a laptop, a cellular phone, a smartphone, a smart pad, a portable multimedia player (PMP), a personal digital assistant (PDA), an MP3 player, etc.

While the present invention has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. A display device, comprising:

a display unit comprising a first pixel, a second pixel disposed adjacent to the first pixel in a first direction, a third pixel disposed adjacent to the first pixel in a second direction crossing the first direction, and a fourth pixel disposed adjacent to the third pixel in the first direction, wherein each of the first to fourth pixels comprises a first sub-pixel and a second sub-pixel;

a data driver configured to output a plurality of data voltages;

a selective output unit configured to output the data voltages to the first to fourth pixels in a different order for each of a plurality of frames; and a scan driver configured to output a first scan signal to the first pixel and the second pixel, and to output a second scan signal which is delayed from the first scan signal to the third pixel and the fourth pixel, wherein the first sub-pixel of each of the first pixel and the third pixel displays a same first color, wherein the second sub-pixel of each of the first pixel and the third pixel displays a same second color, and wherein, in an $N^{th}$ frame of the plurality of frames, the first sub-pixel and the second sub-pixel of the first pixel each connected to a respective one of first adjacent data lines stores the data voltage of the first pixel in a floating state with the data driver, and the first sub-pixel and the second sub-pixel of the third pixel each connected to a respective one of second adjacent data lines stores the data voltage of the third pixel in a connection state with the data driver.

2. The display device of claim 1, wherein the display unit further comprises a first data line, a second data line, a third data line, a fourth data line, a fifth data line, a sixth data line, a seventh data line, and an eighth data line arranged in the first direction and extending in the second direction, wherein the first sub-pixel and the second sub-pixel of the first pixel are connected to the second data line and the third data line, respectively, wherein the first sub-pixel and the second sub-pixel of the second pixel are connected to the sixth data line and the seventh data line, respectively, wherein the first sub-pixel and the second sub-pixel of the third pixel are connected to the fifth data line and the fourth data line, respectively, and wherein the first sub-pixel and the second sub-pixel of the fourth pixel are connected to the first data line and the eighth data line, respectively.

3. The display device of claim 2, wherein the selective output unit comprises:

a first switch group configured to connect a first output terminal and a second output terminal of the data driver to the second data line and the third data line, respectively, in response to a first switch control signal;

a second switch group configured to connect the first output terminal and the second output terminal to the sixth data line and the seventh data line, respectively, in response to a second switch control signal;

a third switch group configured to connect the first output terminal and the second output terminal to the fifth data line and the fourth data line, respectively, in response to a third switch control signal; and a fourth switch group configured to connect the first output terminal and the second output terminal to the first data line and the eighth data line, respectively, in response to a fourth switch control signal.

4. The display device of claim 2, wherein the first sub-pixel of each of the first pixel and the third pixel is a red sub-pixel, wherein the first sub-pixel of each of the second pixel and the fourth pixel is a blue sub-pixel, and wherein the second sub-pixel of each of the first pixel, the second pixel, the third pixel, and the fourth pixel is a green sub-pixel.

5. The display device of claim 4, wherein the first scan signal is activated for one horizontal period beginning from a latter section of a first horizontal period, and wherein the second scan signal is activated for one horizontal period beginning from a latter section of a second horizontal period that is consecutive to the first horizontal period.

6. The display device of claim 5, wherein, in the $N^{th}$ frame, the selective output unit outputs the data voltage of the first pixel in an initial section of the first horizontal period, outputs the data voltage of the second pixel in the latter section of the first horizontal period, outputs the data voltage of the fourth pixel in an initial section of the second horizontal period that is consecutive to the first horizontal period, and outputs the data voltage of the third pixel in the latter section of the second horizontal period.

7. The display device of claim 6, wherein the green sub-pixel of each of the second pixel and the third pixel stores the data voltage in the connection state with the data driver, and wherein the green sub-pixel of each of the first pixel and the fourth pixel stores the data voltage in the floating state with the data driver.

8. The display device of claim 6, wherein the blue sub-pixel of the second pixel stores the data voltage in the connection state with the data driver, and wherein the blue sub-pixel of the fourth pixel stores the data voltage in the floating state with the data driver.

9. The display device of claim 5, wherein, in an $(N+1)^{th}$ frame of the plurality of frames, the selective output unit outputs the data voltage of the second pixel in an initial section of the first horizontal period, outputs the data voltage of the first pixel in the latter section of the first horizontal period, outputs the data voltage of the third pixel in an initial section of the second horizontal period that is consecutive to the first horizontal period, and outputs the data voltage of the fourth pixel in the latter section of the second horizontal period.

10. The display device of claim 9, wherein, in the $(N+1)^{th}$ frame, the red sub-pixel of the first pixel stores the data voltage in the connection state with the data driver, and wherein the red sub-pixel of the third pixel stores the data voltage in the floating state with the data driver.

11. The display device of claim 9, wherein the green sub-pixel of each of the first pixel and the fourth pixel stores the data voltage in the connection state with the data driver, and wherein the green sub-pixel of each of the second pixel and the third pixel stores the data voltage in the floating state with the data driver.

12. The display device of claim 9, wherein the blue sub-pixel of the second pixel stores the data voltage in the floating state with the data driver, and wherein the blue sub-pixel of the fourth pixel stores the data voltage in the connection state with the data driver.

13. A method of driving a display device, comprising:

outputting a plurality of data voltages by a data driver to a first pixel of a display unit, a second pixel of the display unit, a third pixel of the display unit, and a fourth pixel of the display unit in a different order for each of a plurality of frames, wherein the second pixel is disposed adjacent to the first pixel in a first direction, the third pixel is disposed adjacent to the first pixel in a second direction crossing the first direction, and the fourth pixel is disposed adjacent to the third pixel in the first direction, and wherein each of the first to fourth pixels comprises a first sub-pixel and a second sub-pixel;

outputting a first scan signal to the first pixel and the second pixel; and outputting a second scan signal which is delayed from the first scan signal to the third pixel and the fourth pixel, wherein the first sub-pixel of each of the first pixel and the third pixel displays a same color, wherein the second sub-pixel of each of the first pixel and the third pixel displays a same second color, and wherein, in an $N^{th}$ frame of the plurality of frames, the first sub-pixel and the second sub-pixel of the first pixel each connected to a respective one of first adjacent data lines stores the data voltage of the first pixel in a floating state with the data driver, and the first sub-pixel and the second sub-pixel of the third pixel each connected to a respective one of second adjacent data lines stores the data voltage of the third pixel in a connection state with the data driver.

14. The method of claim 13, wherein, in the $N^{th}$ frame, the first pixel stores a first data voltage in the floating state with the data driver in an initial section of a first horizontal period, the second pixel stores a second data voltage in the connection state with the data driver in a latter section of the first horizontal period, the fourth pixel stores the first data voltage in the floating state with the data driver in an initial section of a second horizontal period that is consecutive to the first horizontal period, and the third pixel stores the second data voltage in the connection state with the data driver in a latter section of the second horizontal period.

15. The method of claim 14, wherein the first data voltage stored in a red sub-pixel of the first pixel and the second data voltage stored in a red sub-pixel of the third pixel are alternately arranged in a zigzag manner in the second direction, and wherein the second data voltage stored in a blue sub-pixel of the second pixel and the first data voltage stored in a blue sub-pixel of the fourth pixel are alternately arranged in a zigzag manner in the second direction.

16. The method of claim 14, wherein the first data voltage stored in a green sub-pixel of the first pixel and the second data voltage stored in a green sub-pixel of the third pixel are alternately arranged in the second direction, and wherein the second data voltage stored in a green sub-pixel of the second pixel and the first data voltage stored in a green sub-pixel of the fourth pixel are alternately arranged in the second direction.

17. The method of claim 13, wherein, in an $(N+1)^{th}$ frame of the plurality of frames, the second pixel stores a first data voltage in the floating state with the data driver in an initial section of a first horizontal period, the first pixel stores a second data voltage in the connection state with the data driver in a latter section of the first horizontal period, the third pixel stores the first data voltage in the floating state with the data driver in an initial section of a second horizontal period that is consecutive to the first horizontal period, and the fourth pixel stores the second data voltage in the connection state with the data driver in a latter section of the second horizontal period.

18. The method of claim 17, wherein the second data voltage stored in a red sub-pixel of the first pixel and the first data voltage stored in a red sub-pixel of the third pixel are alternately arranged in a zigzag manner in the second direction, and wherein the first data voltage stored in a blue sub-pixel of the second pixel and the second data voltage stored in a blue sub-pixel of the fourth pixel are alternately arranged in a zigzag manner in the second direction.

19. The method of claim 17, wherein the second data voltage stored in a green sub-pixel of the first pixel and the first data voltage stored in a green sub-pixel of the third pixel are alternately arranged in the second direction, and wherein the first data voltage stored in a green sub-pixel of the second pixel and the second data voltage stored in a green sub-pixel of the fourth pixel are alternately arranged in the second direction.

20. A display device, comprising:

a display unit comprising a first pixel, a second pixel disposed adjacent to the first pixel in a first direction, a third pixel disposed adjacent to the first pixel in a second direction crossing the first direction, and a fourth pixel disposed adjacent to the third pixel in the first direction, wherein each of the first to fourth pixels comprises a first sub-pixel and a second sub-pixel;

a data driver configured to output a plurality of data voltages;

a selective output unit configured to output the data voltages to the first to fourth pixels in a different order for each of a plurality of frames; and a scan driver configured to output a first scan signal to the first pixel and the second pixel, and to output a second scan signal which is delayed from the first scan signal to the third pixel and the fourth pixel, wherein the display unit further comprises a first data line, a second data line, a third data line, a fourth data line, a fifth data line, a sixth data line, a seventh data line, and an eighth data line arranged in the first direction and extending in the second direction, wherein the first sub-pixel and the second sub-pixel of the first pixel are connected to the second data line and the third data line, respectively, wherein the first sub-pixel and the second sub-pixel of the second pixel are connected to the sixth data line and the seventh data line, respectively, wherein the first sub-pixel and the second sub-pixel of the third pixel are connected to the fifth data line and the fourth data line, respectively, and wherein the first sub-pixel and the second sub-pixel of the fourth pixel are connected to the first data line and the eighth data line, respectively.

* * * * *